US010232379B2

(12) United States Patent
Kim et al.

(10) Patent No.: US 10,232,379 B2
(45) Date of Patent: Mar. 19, 2019

(54) MEDICINE PREPARATION METHOD AND MEDICINE PREPARATION APPARATUS

(71) Applicants: Tae You Kim, Busan (KR); Ji Min Kim, Busan (KR); Ji Sung Kim, Busan (KR); Eun Shin Park, Busan (KR)

(72) Inventors: Tae You Kim, Busan (KR); Ji Min Kim, Busan (KR); Ji Sung Kim, Busan (KR); Eun Shin Park, Busan (KR)

(73) Assignees: Tae You Kim, Busan (KR); Ji Min Kim, Busan (KR); Ji Sung Kim, Busan (KR); Eun Shin Park, Busan (KR)

( * ) Notice: Subject to any disclaimer, the term of this patent is extended or adjusted under 35 U.S.C. 154(b) by 400 days.

(21) Appl. No.: 14/739,939

(22) Filed: Jun. 15, 2015

(65) Prior Publication Data

US 2015/0274343 A1 Oct. 1, 2015

Related U.S. Application Data

(63) Continuation of application No. PCT/KR2013/011860, filed on Dec. 19, 2013.

(30) Foreign Application Priority Data

Dec. 20, 2012 (KR) ..... 10-2012-0149762
Dec. 31, 2012 (KR) ..... 10-2012-0158543
(Continued)

(51) Int. Cl.
*A61J 7/00* (2006.01)
*B02C 19/08* (2006.01)
(Continued)

(52) U.S. Cl.
CPC ..... *B02C 19/08* (2013.01); *A61J 7/0007* (2013.01); *B02C 1/14* (2013.01); *B02C 4/02* (2013.01); *B02C 1/04* (2013.01); *B65B 61/24* (2013.01)

(58) Field of Classification Search
CPC ..... B02C 19/08; A61J 7/0007
(Continued)

(56) References Cited

U.S. PATENT DOCUMENTS 2,318,911 A 5/1943 Zweber et al.
2,526,273 A * 10/1950 Rimes ..... A47J 43/26 200/84 C
(Continued)

FOREIGN PATENT DOCUMENTS

CN 201510530 U 6/2010
CN 202505787 U 10/2012
(Continued)

OTHER PUBLICATIONS

Japanese Office Action dated Jun. 14, 2016 in counterpart Japanese Patent Application No. 2015-546400 (4 pages in Japanese).
(Continued)

*Primary Examiner* — Faye Francis
(74) *Attorney, Agent, or Firm* — NSIP Law

(57) ABSTRACT

Provided are a method and an apparatus for preparing medicines. The method for preparing medicines includes a distribution step of distributing at least one pill into at least one medicine packet and a crushing step of applying a pressure to the medicine packet with the pill to crush the pill. The apparatus for preparing medicines includes a distributor configured to distribute at least one pill into at least one medicine packet and a crusher configured to apply a pressure to the medicine packet with the pill to crush the pill.

9 Claims, 22 Drawing Sheets

(30) Foreign Application Priority Data

Apr. 12, 2013 (KR) ..... 10-2013-0040552
Jul. 10, 2013 (KR) ..... 10-2013-0081205

(51) Int. Cl.
*B02C 1/14* (2006.01)
*B02C 4/02* (2006.01)
*B65B 61/24* (2006.01)
*B02C 1/04* (2006.01)

(58) Field of Classification Search
USPC ..... 241/DIG. 27
See application file for complete search history.

(56) References Cited

U.S. PATENT DOCUMENTS 4,209,136 A * 6/1980 Linden ..... A61J 7/0007 241/169.2
4,366,930 A * 1/1983 Trombetti, Jr. ..... A61J 7/0007 241/169
4,694,996 A 9/1987 Siegel
4,765,549 A * 8/1988 Sherman ..... A61J 7/0007 241/169
5,178,337 A * 1/1993 Lupoli ..... A61J 7/0007 241/169
5,464,393 A * 11/1995 Klearman ..... A61J 7/0007 241/DIG. 27
5,569,555 A * 10/1996 Goldstein ..... B02C 1/005 241/201
5,618,004 A * 4/1997 Klearman ..... A61J 7/0007 241/169.2
5,863,001 A 1/1999 Schulze
5,915,637 A 6/1999 Parsons
6,508,424 B1 * 1/2003 Marshall ..... A61J 7/0007 241/169.1
6,523,766 B1 2/2003 Watt
6,637,685 B1 * 10/2003 Kruger ..... A61J 7/0007 241/169.1
7,543,770 B2 * 6/2009 Peron ..... A61J 7/0007 241/169
7,648,093 B2 * 1/2010 Kruger ..... A61J 7/0007 241/169
7,735,763 B2 * 6/2010 Bell ..... A61J 7/0007 241/169.1
9,717,651 B2 * 8/2017 Hohl ..... A61J 7/0007
2005/0127218 A1 6/2005 Demske et al.
2006/0043224 A1 3/2006 Weisbeck
2008/0237381 A1 10/2008 Kruger
2012/0187229 A1 7/2012 Clouser et al.
2012/0256024 A1 10/2012 Engel et al.
2012/0312906 A1 12/2012 Dow et al.

FOREIGN PATENT DOCUMENTS

DE 2807174 A1 8/1978
FR 1360658 A 5/1964
GB 1552749 A 9/1979
JP 61-74653 A 4/1986
JP 3027970 U 8/1996
KR 1997-0005158 Y1 5/1997
KR 2002-0028535 A 4/2002
KR 10-2012-0003579 A 1/2012
KR 10-2013-0111896 A 10/2013
WO WO 2008/116315 A1 10/2008

OTHER PUBLICATIONS

European Search Report dated Jul. 15, 2016 in counterpart European Application No. 13865423.1 (8 pages in English).
International Search Report dated Mar. 31, 2014 in counterpart International Application No. PCT/KR2013/011860 (4 pages, in Korean, with English language translation).

* cited by examiner

MEDICINE PREPARATION METHOD AND MEDICINE PREPARATION APPARATUS

RELATED APPLICATION

This application claims the benefit of Korean Patent Application No. 10-2012-0149762, filed on Dec. 20, 2012, 10-2012-0158543, filed on Dec. 31, 2012, 10-2013-0040552, filed on Apr. 12, 2013, and 10-2013-0081205, filed on Jul. 10, 2013, in the Korean Intellectual Property Office, the disclosure of which is incorporated herein in its entirety by reference for all purposes.

BACKGROUND

1. Field

One or more exemplary embodiments relate to a method and an apparatus for preparing medicines, and more particularly, a method for preparing medicines includes a distribution step of distributing at least one pill into at least one medicine packet and a crushing step of applying a pressure to the medicine packet with the pill to crush the pill and an apparatus for preparing medicines includes a distributor configured to distribute at least one pill into at least one medicine packet and a crusher configured to apply a pressure to the medicine packet with the pill to crush the pill.

2. Description of the Related Art

In general, drugs are produced as pills and inserted into medicine packets to be provided to patients. Such drugs in pill form have a relatively small contact area inside a human body and thus may work slowly. Furthermore, since there are patients who have difficulty in taking pills, pills are often crushed into powders to prepare powdered medicines.

However, when such drugs in powder form are prepared, small particles that may damage a preparer's health may be generated. In addition, a crusher should be cleaned with each use because an undesired medicinal component may be added due to powders stuck to the crusher.

SUMMARY

One or more exemplary embodiments of a method for preparing medicines include a distribution step of distributing at least one pill into at least one medicine packet and a crushing step of applying a pressure to the medicine packet with the pill to crush the pill.

One or more exemplary embodiments of an apparatus for preparing medicines include a distributor configured to distribute at least one pill into at least one medicine packet and a crusher configured to apply a pressure to the medicine packet with the pill to crush the pill.

Additional aspects will be set forth in part in the description which follows and, in part, will be apparent from the description, or may be learned by practice of the presented exemplary embodiments.

According to one or more exemplary embodiments, a method for preparing medicines includes a distribution step of distributing at least one pill into at least one medicine packet and a crushing step of applying a pressure to the medicine packet with the pill to crush the pill.

The crushing step may be performed by a crusher. The crusher may include a supporting part on which the medicine packet with the pill is mounted, a pressing part disposed over and spaced a certain distance from the supporting part, and an impact part disposed over and spaced a certain distance from the pressing part, in which the pressing part includes a plurality of holes, and the impact part includes an impact plate and a plurality of impact poles that pass through the plurality of holes. The crushing step may include the step of disposing the medicine packet between the supporting part and the pressing part, the step of applying a pressure to the medicine packet by shifting the pressing part, and the step of applying a pressure to the medicine packet by shifting the impact poles to pass through the plurality of holes.

The impact plate and the impact poles of the impact part may be connected to or separated from each other. The crushing step may include the step of applying an impact to the medicine packet by separating the impact poles from the impact plate and dropping the separated impact poles.

The crushing step may include the step of connecting the impact plate to the dropped impact poles to raise the dropped impact poles.

The crusher may include one or more roller couples and a conveyor, in which each of the roller couples has two rollers that are spaced a certain distance from each other, the conveyor conveys the medicine packet between the two rollers that constitute each of the roller couples. The crushing step may include the step of utilizing the conveyor to pass the medicine packet between the two rollers that constitute each of the roller couples.

The crusher may include a first crushing plate, a second crushing plate connected by a hinge part at a certain angle, and a driver configured to control the angle between the first crushing plate and the second crushing plate. The crushing step may include the step of disposing the medicine packet between the first crushing plate and the second crushing plate, and the step of decreasing the angle between the first crushing plate and the second crushing plate to apply an impact to the medicine packet.

The crusher may include a first crushing part, a second crushing part disposed a certain distance from each other, a driver disposed over at least one of the first crushing part and the second crushing part to shift the first crushing part and the second crushing part in a vertical direction, and a conveyor disposed under the first crushing part and the second crushing part to convey the medicine packet. The crushing step may include the step of conveying the medicine packet under the first crushing part and the second crushing part such that the first crushing part and the second crushing part apply a pressure to the medicine packet.

The crusher may further include a central spindle and a connection part performing a seesaw movement about the central spindle in which the first crushing part and the second crushing part are connected by hinges on both sides of the connection part and the driver may include a cylinder.

The crushing step may include the step of applying an impact to the medicine packet by the connection part performing a seesaw movement about the central spindle to shift the first crushing part and the second crushing part in opposite vertical directions.

The crusher may include a central spindle, a connection part performing a seesaw movement about the central spindle, a first crushing part and a second crushing part connected by hinges on both sides of the connection part to perform an up-and-down movement, a cylinder connected to at least one of the first crushing part and the second crushing part to cause a vertical shift, and a conveyor disposed under the first crushing part and the second crushing part to convey the medicine packet. The crushing step may include the step of conveying, by the conveyor, the medicine packet under the first crushing part and the second crushing part such that the first crushing part and the second crushing part apply an impact to the medicine packet.

According to one or more exemplary embodiments, an apparatus for preparing medicines may include a distributor configured to distribute at least one pill into at least one medicine packet and a crusher configured to apply a pressure to the medicine packet with the pill to crush the pill.

The crusher may include a supporting part on which the medicine packet with the pill is mounted, a pressing part disposed over and spaced a certain distance from the supporting part, and an impact part disposed over and spaced a certain distance from the pressing part, in which the pressing part includes a plurality of holes, and the impact part includes an impact plate and a plurality of impact poles that pass through the plurality of holes.

The impact plate and the impact poles may be connected to or separated from each other.

The crusher may include one or more roller couples and a conveyor in which each of the roller couples has two rollers that are spaced a certain distance from each other and the conveyor conveys the medicine packet between the two rollers that constitute each of the roller couples.

In a traveling direction of the medicine packet, a lower-rank roller couple may have a smaller distance than a higher-rank roller couple.

At least one of the rollers may have a saw-toothed portion formed on at least one portion of a circumference thereof.

The crusher may include a first crushing plate, a second crushing plate connected by a hinge part at a certain angle, and a driver configured to control the angle between the first crushing plate and the second crushing plate.

At least one of the first crushing plate and the second crushing plate may include a concave-convex part.

The crusher may include a first crushing part and a second crushing part disposed a certain distance from each other, a driver disposed over at least one of the first crushing part and the second crushing part to shift the first crushing part and the second crushing part in a vertical direction, and a conveyor disposed under the first crushing part and the second crushing part to convey the medicine packet.

The crusher may further include a central spindle and a connection part performing a seesaw movement about the central spindle in which the first crushing part and the second crushing part are connected by hinges on both sides of the connection part and the driver includes a cylinder.

The crusher may include a first press and a second press. Each of the first press and the second press may include a first pressing part and a second pressing part. The medicine packet may be pressed by shifting the first pressing part and the second pressing part in opposite directions.

At least one of the first pressing part and the second pressing part may include a concave-convex part.

A distance between the first pressing part and the second pressing part may sequentially decrease in a traveling direction of the medicine packet from the first press to the second press.

A coating layer with high ductility may be formed on an uneven surface on which the concave-convex part is formed.

According to one or more exemplary embodiments, an apparatus for preparing medicines may include a supporting part on which a medicine packet with a pill is mounted, and a pressing part configured to press the medicine packet with the pill to crush the pill, in which the pressing part includes a pressure surface that comes in contact with and applies an impact to the medicine packet when the medicine packet is pressed and the pressure surface partially has different heights and thus different distances from the supporting part.

The pressure surface may have an inclined surface having a certain inclination angle with respect to the supporting part formed on at least one portion thereof.

The pressure surface may have a curved surface having a certain curvature formed on at least one portion thereof, by increasing or decreasing a certain inclination angle with respect to the supporting part.

The pressure surface may have one or more steps and include a plurality of impact surfaces with different heights.

The plurality of impact surfaces may have different distances from the supporting part.

The steps may ascend or descend in one direction, and a distance between one of the impact surfaces and the supporting part may sequentially increase or decrease in one direction.

At least one of the plurality of impact surfaces may include a groove for capturing air in the packet.

At least one of the plurality of impact surfaces may have an uneven surface.

At least one of the plurality of impact surfaces may have an inclined surface having a certain inclination angle with respect to the supporting part.

At least one of the plurality of impact surfaces may have a curved surface with a certain curvature.

An edge of each impact surface may be curved with a curvature.

The pressing part may selectively include a plurality of detachable pressure units, and each of the pressure units may have one or more impact surfaces.

Among the impact surfaces, a bottom-level impact surface may have a small width than the medicine packet with the pill.

BRIEF DESCRIPTION OF THE DRAWINGS

These and/or other aspects will become apparent and more readily appreciated from the following description of the exemplary embodiments, taken in conjunction with the accompanying drawings in which.

DETAILED DESCRIPTION

Figure 1:
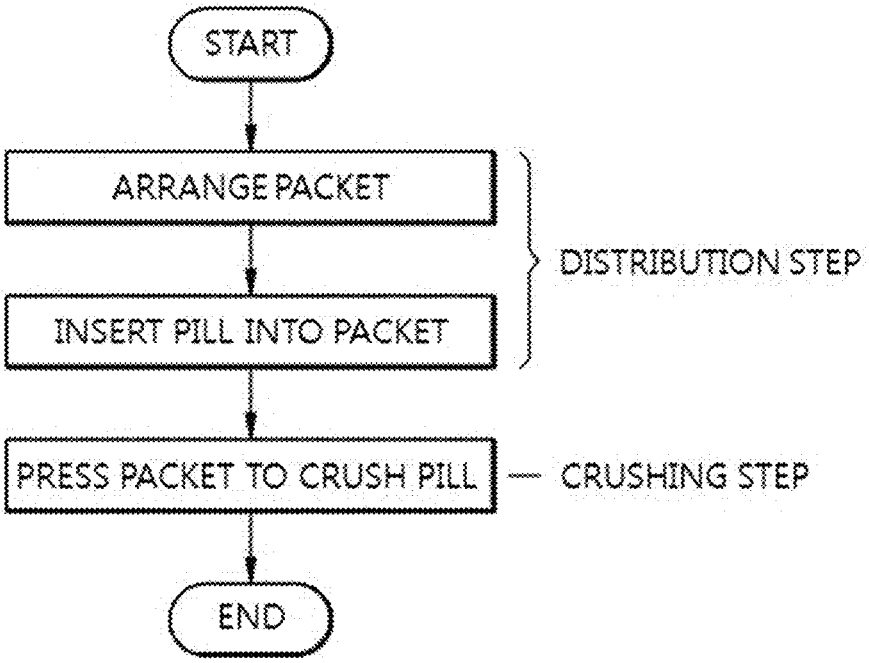
FIG. 1 is a flowchart illustrating a method for preparing medicines according to an embodiment of the present disclosure.

Advantages and features of the present invention, and implementation methods thereof will be clarified through following embodiments described with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Like reference numerals refer to like elements throughout.

Spatially relative terms, such as "below," "beneath," "lower," "above," "upper," "on," "between," and the like, may be used herein for ease of description to describe the relationship of one element or member to another element(s) or member(s) as illustrated in the figures. It will be understood that the spatially relative terms are intended to encompass different orientations of the member in use or operation, in addition to the orientation depicted in the figures. For example, if the member in the figures is positioned, a "vertical direction" may be interpreted as a "horizontal direction." Thus, the exemplary term "up and down" can encompass both left and right. The member may be otherwise oriented and the spatially relative descriptors used herein interpreted accordingly.

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or members, but do not preclude the presence or addition of one or more other features, integers, steps, operations, elements, members, and/or groups thereof.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In the drawings, the thickness or size of each member is exaggerated, omitted, or schematically illustrated for convenience in description and clarity. Also, the size and area of each element does not entirely reflect an actual size and area.

Angles or directions used to describe the structures of the present invention are based on those shown in the drawings. Unless a reference point of an angle or angular positional relations in the structures of the present invention are clearly described, the related drawings may be referred to.

FIG. 1 is a flowchart illustrating a method for preparing medicines according to an embodiment of the present invention, and FIGS. 2 to 18 are views illustrating a crusher 1 of an apparatus for preparing medicines according to an embodiment of the present invention.

Referring to FIG. 1, the method preparing medicines according to an embodiment of the present invention may include a distribution step of distributing at least one pill into at least one medicine packet and a crushing step of applying a pressure to the medicine packet with the pill to crush the pill.

The distribution step may include providing the medicine packet and inserting the pill into the medicine packet. The provision of the medicine packet and the insertion of the pill may be accomplished by any distributor. The crushing of the pill may be accomplished by applying a pressure to the medicine packet to crush the pill inside the medicine packet, which may be performed by any crusher 1.

The apparatus preparing medicines according to an embodiment of the present invention may include a distributor configured to distribute the pills into the medicine packets and a crusher 1 configured to apply a pressure to the medicine packets with the pills to crush the pills.

A step of crushing the pill to prepare a medicinal powder may be performed after the inserting the pills into the medicine packets. Accordingly, the pills are crushed inside the medicine packets, thus preventing medicinal particles from being generated by crushing the pills. Further, since the pills are crushed inside the medicine packets, medicinal particles cannot be stuck to the crusher 1. Thus, the required amount of medicine can be exactly distributed, the crusher 1 do not need to be cleaned, and an unnecessary medicinal component that is resulted from a drug stuck to the crusher 1 may be prevented from being mixed.

According to a method for preparing medicines according to an exemplary embodiment of the present invention, the crushing step is performed by a crusher 1. The crusher 1 includes a supporting part 10 on which a medicine packet P with a pill is mounted, a pressing part 20 disposed over and spaced a certain distance from the supporting part 10, and an impact part 30 disposed over and spaced a certain distance from the pressing part 20. The pressing part 20 includes a plurality of holes 22, and the impact part 30 includes an impact plate 31 and a plurality of impact poles 32 that may pass through the plurality of holes 22. The crushing step may include the step of disposing the medicine packet P between the supporting part 10 and the pressing part 20, the step of applying a first pressure to the medicine packet P by shifting the pressing part 20, and the step of applying a second pressure to the medicine packet P by shifting the impact poles to pass through the plurality of holes 22.

Figure 2:
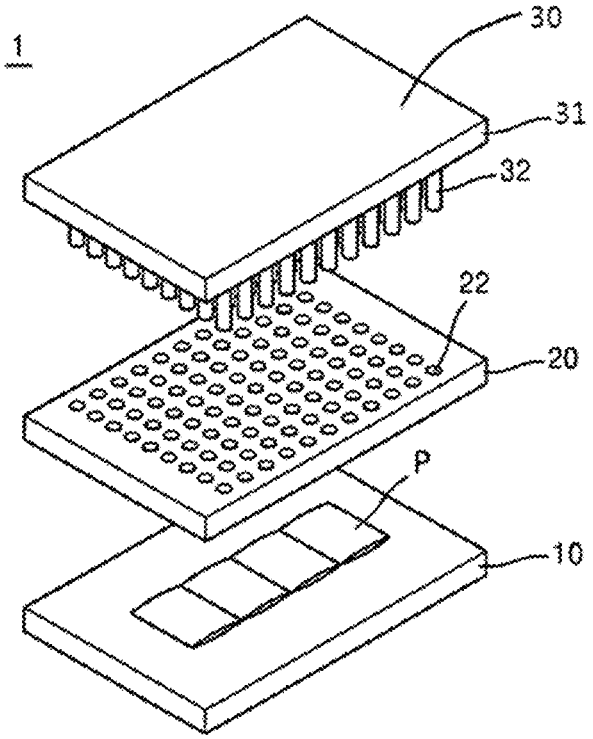
FIGS. 2 to 35 are views illustrating exemplary crushers of exemplary apparatuses for preparing medicines according to various embodiments of the present disclosure.
Figure 3:
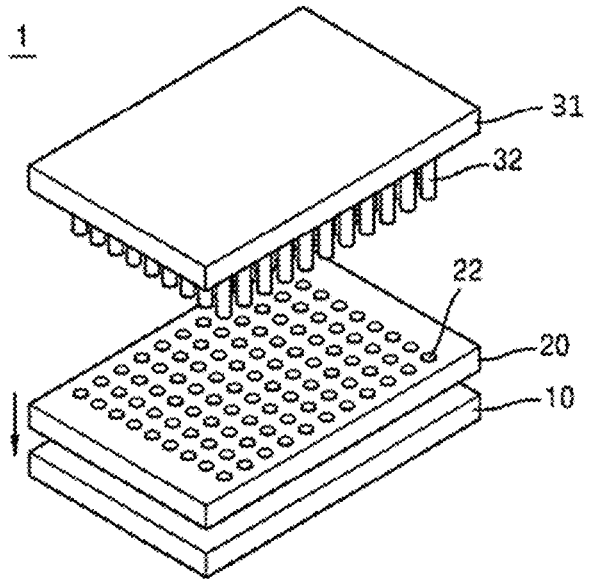
Figure 4:
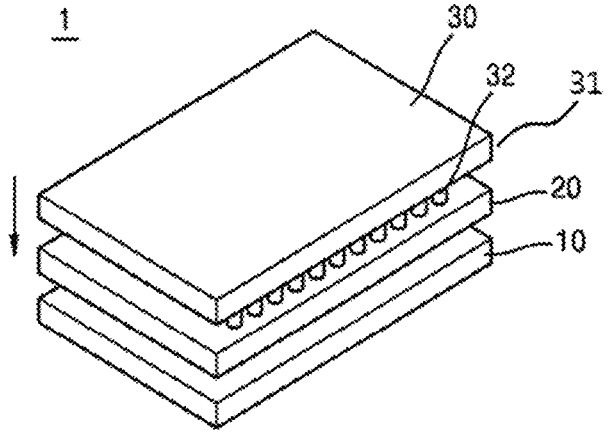

As shown in FIGS. 2 to 4, according to an apparatus for preparing medicines according to an exemplary embodiment of the present invention, the crusher 1 may include a supporting part 10 on which a medicine packet P with a pill is mounted, a pressing part 20 disposed over and spaced a certain distance from the supporting part 10, and an impact part 30 disposed over and spaced a certain distance from the pressing part 20. The pressing part 20 may include a plurality of holes 22, and the impact part 30 may include an impact plate 31 and a plurality of impact poles 32 that may pass through the plurality of holes 22.

First, referring to FIG. 2, the medicine packet P with the pill may be positioned between the supporting part 10 and the pressing part 20, and the impact part 30 may be disposed over the pressing part 20. Next, as shown in FIG. 3, a first pressure may be applied to the medicine packet P positioned between the pressing part 20 and the supporting part 10 by shifting the pressing part 20. In this case, as shown in FIG. 3, the shift of the pressing part 20 may be accomplished by dropping the pressing part 20 downward, but the present invention is not limited thereto.

Next, as shown in FIG. 4, a second pressure may be applied to the medicine packet P by shifting the impact poles 32. In this case, the pressing part 20 may include a plurality of holes 22, and the impact part 30 may include a plurality of impact poles 32 that may pass through the plurality of holes 22. The second pressure may be applied to the medicine packet P by shifting the impact poles 32 to pass through the plurality of holes 22. As shown in FIG. 4, the shift of the impact part 30 may also be accomplished by dropping the impact part 30 downward, but the present invention is not limited thereto.

Since the first pressure and the second pressure are applied by the pressing part 20 and the impact part 30, respectively, the pill inside the medicine packet P can be uniformly crushed. That is, the pill inside the medicine packet P may be partially crushed, uniformly distributed on a plane, and fixed by the first pressure applied by the pressing part 20 and then may be uniformly crushed by the second pressure applied by the impact part 30. Further, as described above, since the pill is crushed inside the medicine packet, medicinal particles cannot be stuck to the crusher 1. Thus, the required amount of medicine can be exactly distributed, the crusher 1 do not need to be cleaned, and an unnecessary medicinal component that is resulted from a drug stuck to the crusher 1 may be prevented from being mixed.

According to a method for preparing medicines according to an exemplary embodiment of the present invention, the impact plate 31 and the impact poles 32 of the impact part 30 are connected to or separated from each other. The crushing step may include the step of applying an impact to the medicine packet by separating the impact poles 32 from the impact plate 31 and dropping the separated impact poles 32.

As shown in FIGS. 5 to 8, according to an apparatus for preparing medicines according to an exemplary embodiment of the present invention, the impact plate 31 and the impact poles 32 may be detachably connected to each other.

Figure 5:
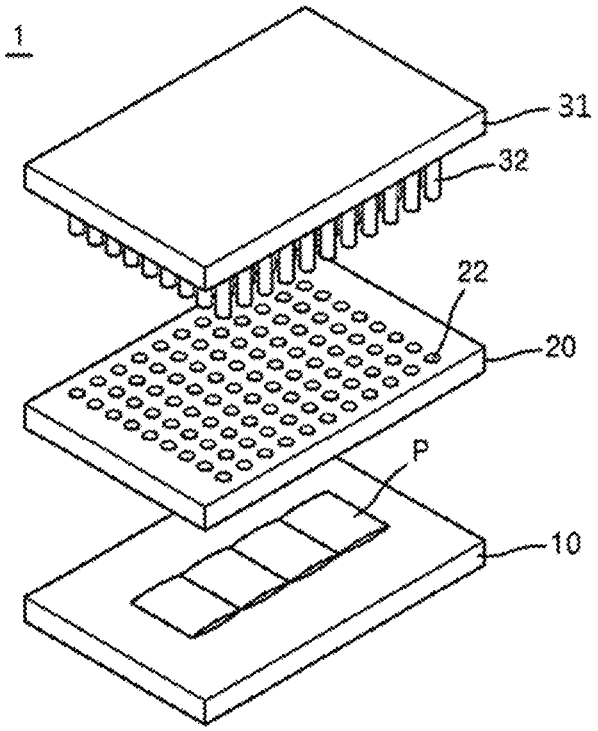
Figure 6:
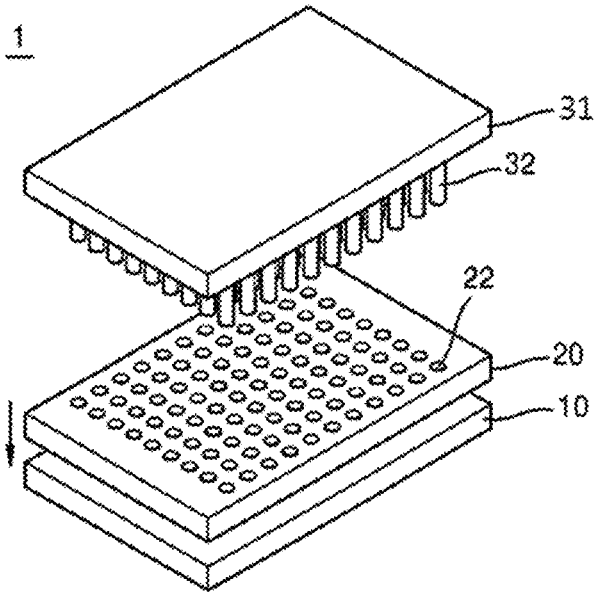

Referring to FIG. 5, as described above, the medicine packet P with the pill may be positioned between the supporting part 10 and the pressing part 20, and the impact part 30 may be disposed over the pressing part 20. Next, as shown in FIG. 6, a first pressure may be applied to the medicine packet P positioned between the pressing part 20 and the supporting part 10 by shifting the pressing part 20. In this case, as shown in FIG. 6, the shift of the pressing part 20 may be accomplished by dropping the pressing part 20 downward, but the present invention is not limited thereto.

Figure 7:
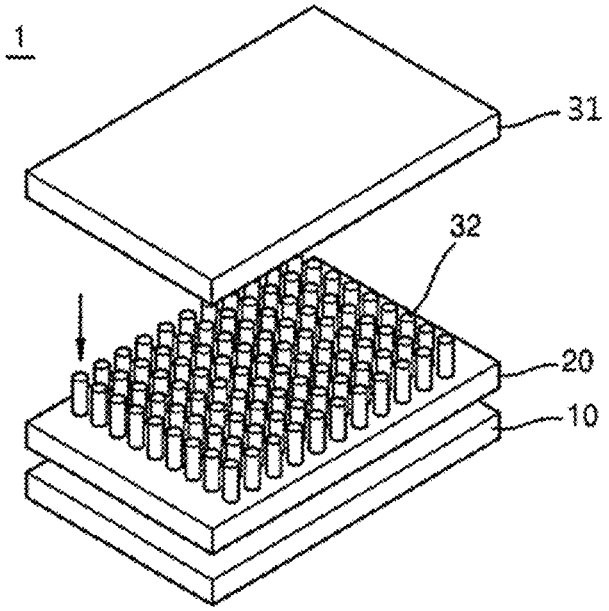

Next, as shown in FIG. 7, a second pressure may be applied to the medicine packet P by shifting the impact part 30. In this case, as described above, the pressing part 20 may include a plurality of holes 22, and the impact part 30 may include a plurality of impact poles 32 that may pass through the plurality of holes 22. The second pressure may be applied to the medicine packet P by shifting the impact poles 32 to pass through the plurality of holes 22.

However, the pressure is applied to the medicine packet P by separating the impact poles 32 and the impact plate 31, which constitute the impact part 30, and dropping the impact poles 32.

That is, as shown in FIG. 7, the impact poles 32 may be separated from the impact plate 31 and dropped from a certain height, thereby applying the second pressure through the holes 22 to the medicine packet P disposed between the pressing part 20 and the support 10. In this case, the impact poles 32 separated apart from the pressing part 20 are dropped. Alternatively, the impact poles 32 may be dropped with some thereof being inserted into the holes 22 formed in the pressing part 20, but the present invention is not limited thereto.

By dropping the impact poles 32 to apply the second pressure, it is possible to easily apply an impact to the medicine packet P and the pill inside the medicine packet P which are disposed between the pressing part 20 and the supporting part 10 and thus effectively crush and grind the pill.

Figure 8:
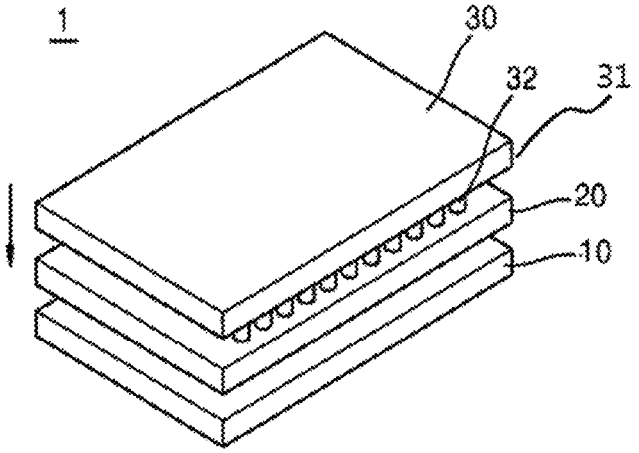

As shown in FIG. 8, a third pressure may be applied by additionally shifting the impact plate 31 to apply a pressure over the impact poles 32. Accordingly, the pressure or impact may be applied to the pill through the impact part 30 and the pressing part 20 three times, thereby resulting in effective crushing and grinding.

In order to reconnect the impact plate 31 and the impact poles 32 that are separated from each other, in a method for preparing medicines according to an embodiment of the present invention, the crushing step may include the step of connecting the impact plate 31 and the impact poles 32 to raise the dropped impact poles 32.

That is, the impact plate 31 and the impact poles 32 may be detachably connected to each other. As an example, the impact plate 32 and the impact poles 32 may be detachably connected by a connector (not shown). As another example, the impact plate 31 and the impact poles 32 may include an electromagnet, in which the magnetic field is produced by an electric current. Thus the impact plate 31 and the impact poles 32 may be connected to or separated from each other depending on the application of an electric current or alternatively may exert either an attractive or a repulsive force on each other. However, the present invention is not limited thereto.

In a method for preparing medicines according to an embodiment of the present invention, the crusher 1 may include one or more roller couples 110, 120, 130 and a conveyor (not shown). Each of the roller couples 110, 120, 130 has two rollers 112, 114, 122, 124, 132, 134 that are spaced a certain distance from each other. The conveyor (not shown) conveys the medicine packet between the two rollers 112, 114, 122, 124, 132, 134 that constitute each of the roller couples 110, 120, 130. The crushing step includes utilizing the conveyor (not shown) to pass the medicine packet between the two rollers 112, 114, 122, 124, 132, 134 that constitute each of the roller couples 110, 120, 130.

In a method for preparing medicines according to an embodiment of the present invention, the crusher 1 may include one or more roller couples 110, 120, 130 and a conveyor (not shown). Each of the roller couples 110, 120, 130 has two rollers 112, 114, 122, 124, 132, 134 that are spaced a certain distance from each other. The conveyor (not shown) conveys the medicine packet between the two rollers 112, 114, 122, 124, 132, 134 that constitute each of the roller couples 110, 120, 130. The crushing step includes the step of utilizing the conveyor (not shown) to pass the medicine packet between the two rollers 112, 114, 122, 124, 132, 134 that constitute each of the roller couples 110, 120, 130.

The roller couple 110, 120, 130 includes the two rollers 112, 114, 122, 124, 132, 134. The two rollers 112, 114, 122, 124, 132, 134 constituting the roller couple 110, 120, 130 are spaced a certain distance from each other. A plurality of roller couples 110, 120, 130 may be provided, and the two rollers 112, 114, 122, 124, 132, 134 constituting each of the roller couples 110, 120, 130 are spaced a certain distance.

For example, the roller couples 110, 120, 130 include a first roller couple 110, a second roller couple 120, and a third roller couple 130. Each roller couple 110, 120, 130 includes the two rollers 112, 114, 122, 124, 132, 134. A distance between the rollers 112 and 114 constituting the first roller couple 110 is different from a distance between the rollers 122 and 124. It is the same with the third roller couple 130.

Figure 9:
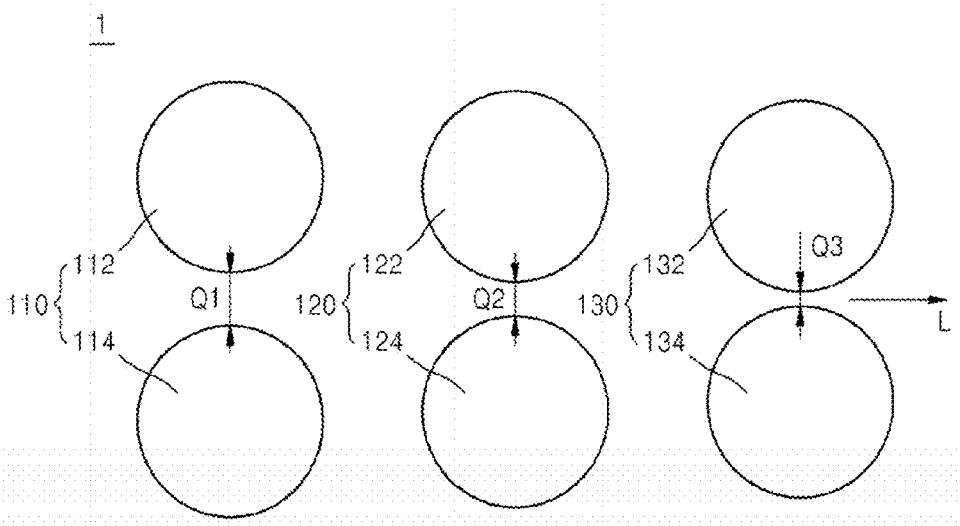

According to a traveling direction of the medicine packet, a lower-rank roller couple may have a smaller distance than a higher-rank roller couple. That is, as shown in FIG. 9, distance Q may be smaller than distance Q1. Relatively large pill pieces may be formed while the pill passes the higher-rank roller couple having a great distance, and the pill pieces may be crushed to a further smaller size while the pill passes the lower-rank roller couple having a small distance, thereby easily preparing a powdered medicine having a further uniform size.

In an apparatus for preparing medicines according to an embodiment of the present invention, at least one of the rollers 112, 114, 122, 124, 132, 134 has a saw-toothed portion formed on at least one portion of its circumference.

Figure 10:
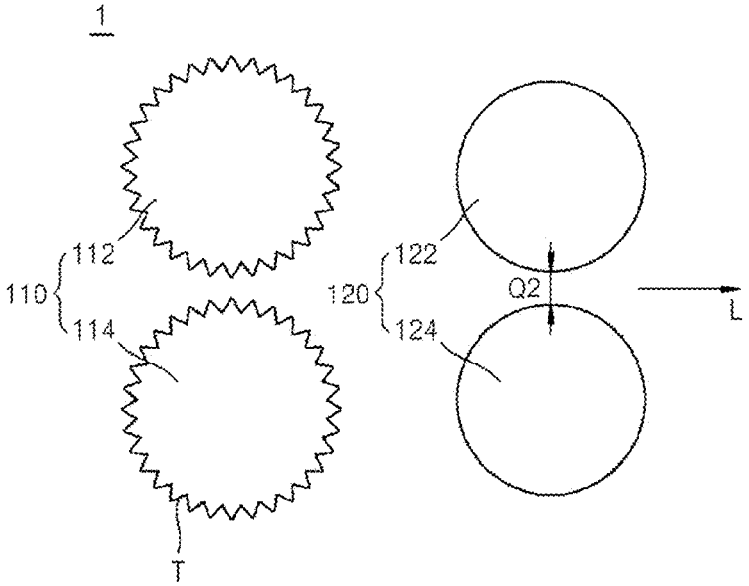

For example, as shown in FIG. 10, the saw-toothed portion may be formed in the rollers constituting the first roller couple 110.

Figure 11:
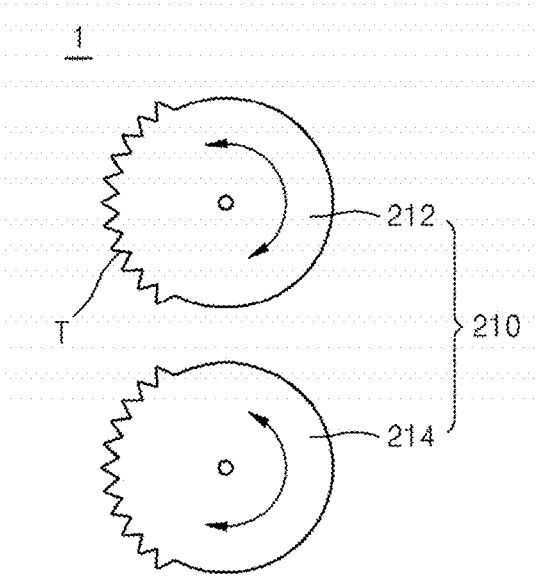

According to an embodiment of the present invention, as shown in FIG. 11, the saw-toothed portion may be formed in at least one portion of rollers 212, 214 of at least one roller couple 210. In this case, the rollers 212, 214 may rotate either clockwise or counterclockwise or alternately clockwise and counterclockwise, but the present invention is not limited thereto. The saw-toothed portion T formed on the rollers 212 and 214 may facilitate the crushing and the grinding of the pill.

It will be appreciated that the saw-toothed portion T may have a certain concave-convex shape rather than a general saw-toothed shape, but the present invention is not limited thereto.

Figure 12:
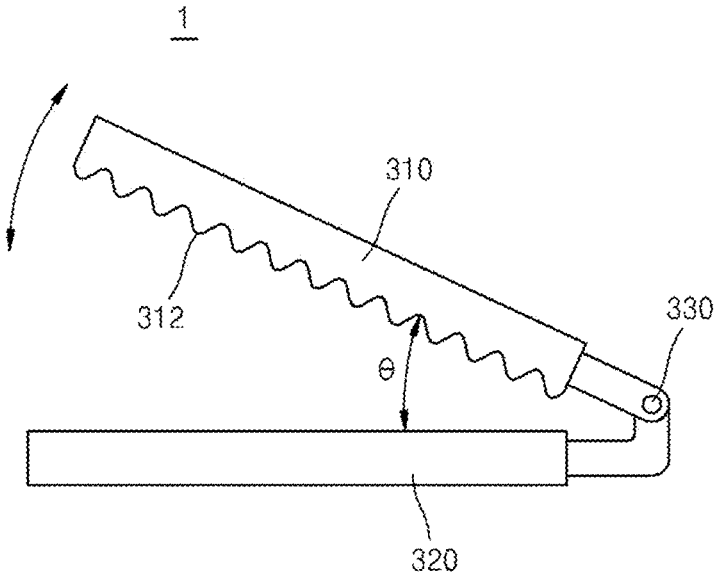
Figure 13:
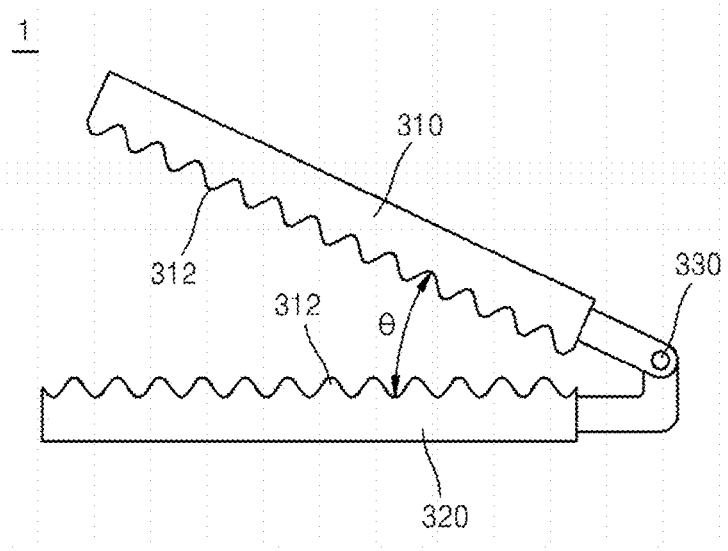

Referring to FIGS. 12 and 13, according to a method for preparing medicines according to an exemplary embodiment of the present invention, the crusher 1 includes a first crushing plate 310 and a second crushing plate 320 connected by a hinge part 330 at a certain angle θ and a driver configured to control the angle θ between the first crushing plate 310 and the second crushing plate 320. The crushing step includes the step of disposing the medicine packet between the first crushing plate 310 and the second crushing plate 320, and the step of decreasing the angle θ between the first crushing plate 310 and the second crushing plate 320 to apply an impact to the medicine packet.

According to an apparatus for preparing medicines according to an embodiment of the present invention, the crusher 1 includes a first crushing plate 310 and a second crushing plate 320 connected by a hinge part 330 at a certain angle θ and a driver (not shown) configured to control the angle θ between the first crushing plate 310 and the second crushing plate 320.

A medicine packet with a pill is positioned between the first crushing plate 310 and the second crushing plate 320, and a pressure may be applied to the pill between the first crushing plate 310 and the second crushing plate 320 by controlling the angel θ between the first crushing plate 310 and the second crushing plate 320. That is, the medicine packet with the pill is positioned between the first crushing plate 310 and the second crushing plate 320, and then a pressure may be applied to the pill between the first crushing plate 310 and the second crushing plate 320 by decreasing the angel θ between the first crushing plate 310 and the second crushing plate 320. In other words, as the first crushing plate 310 and the second crushing plate 320 are alternately and repeatedly moved between open and closed states, a pressure may be applied to the pill between the first crushing plate 310 and the second crushing plate 320, thereby crushing and grinding the pill.

Preferably, at least one of the first crushing plate 310 and the second crushing plate 320 may include a concave-convex part 312. For example, as shown in FIG. 12, the concave-convex part 312 may be formed on the first crushing plate 310. As shown in FIG. 13, the concave-convex part 312 may be formed on both of the first crushing plate 310 and the second crushing plate 320, thereby facilitating the crushing and grinding of the pill.

Figure 14:
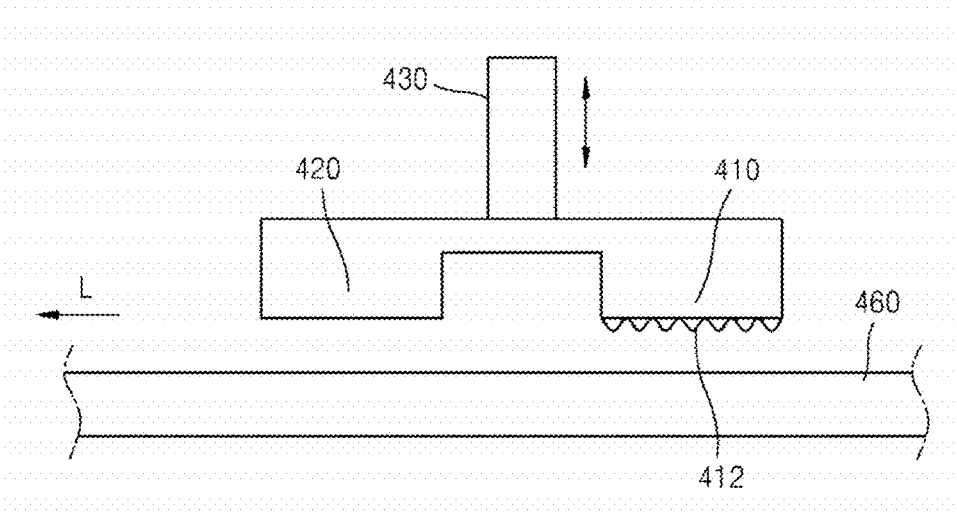
Figure 15:
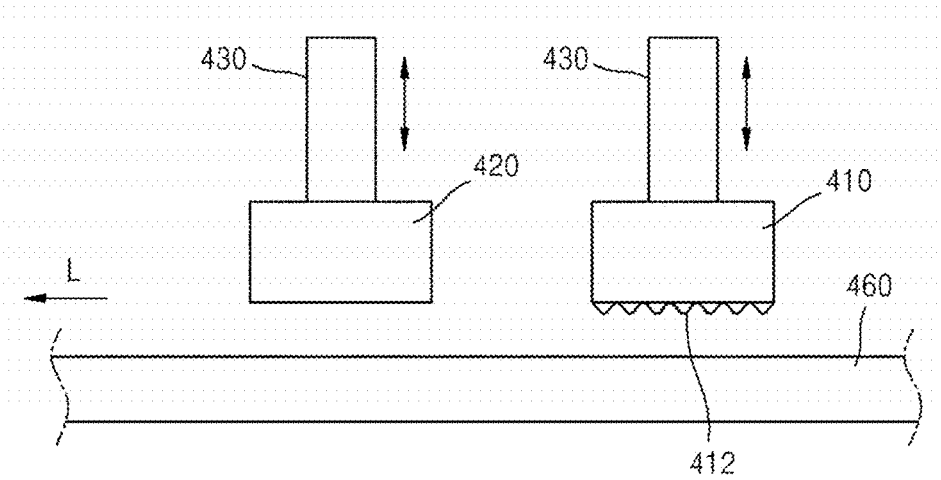

FIGS. 14 and 15 are views illustrating a crusher 1 according to an embodiment of the present invention.

Referring to FIGS. 14 and 15, the crusher according to an embodiment of the present invention includes a conveyor 440, a first crushing part 410 and a second crushing part 420 disposed over and spaced a certain distance from the conveyor 440, and a driver 430 configured to shift the first crushing part 410 and the second crushing part 420 in a vertical direction.

A medicine packet with a pill is conveyed through the conveyor 440, and the first crushing part 410 and the second crushing part 420 may apply a pressure to the medicine packet to crush the pill. In this case, an additional crushing part may further be provided in addition to the first crushing part 410 and the second crushing part 420.

A concave-convex part 412 may be formed on a bottom of at least one of the first crushing plate 410 and the second crushing plate 420. The concave-convex part 412 may have, for example, a shape in which a plurality of three-dimensional figures containing polygonal or curved surfaces are formed, but the present invention is not limited thereto. Although FIGS. 14 and 15 show that a traveling direction L is from the first crushing part 410 having the concave-convex part 412 formed therein to the second crushing plate 420, it will be appreciated that the present invention is not limited thereto.

The driver 430 may repeatedly move the first crushing part 410 and the second crushing part 420 in the vertical direction to crush the pill. The driver 430 may have a single connection with the first crushing part 410 and the second crushing part 420 as shown in FIG. 14 or may be separately connected to the first crushing part 410 and the second crushing part 420 as shown in FIG. 15. However, the present invention is not limited thereto.

Figure 16:
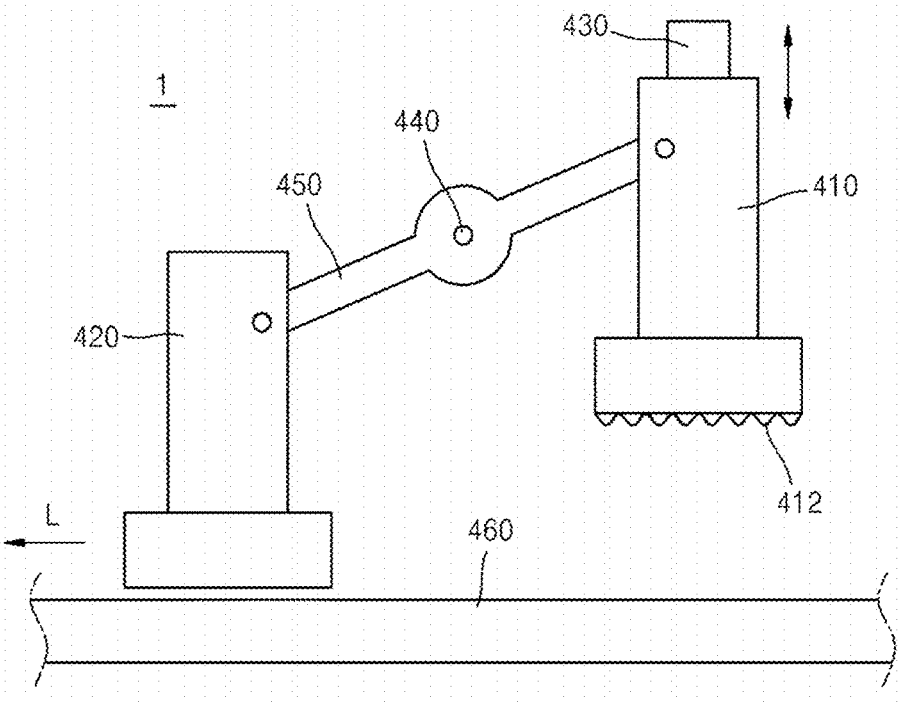
Figure 17:
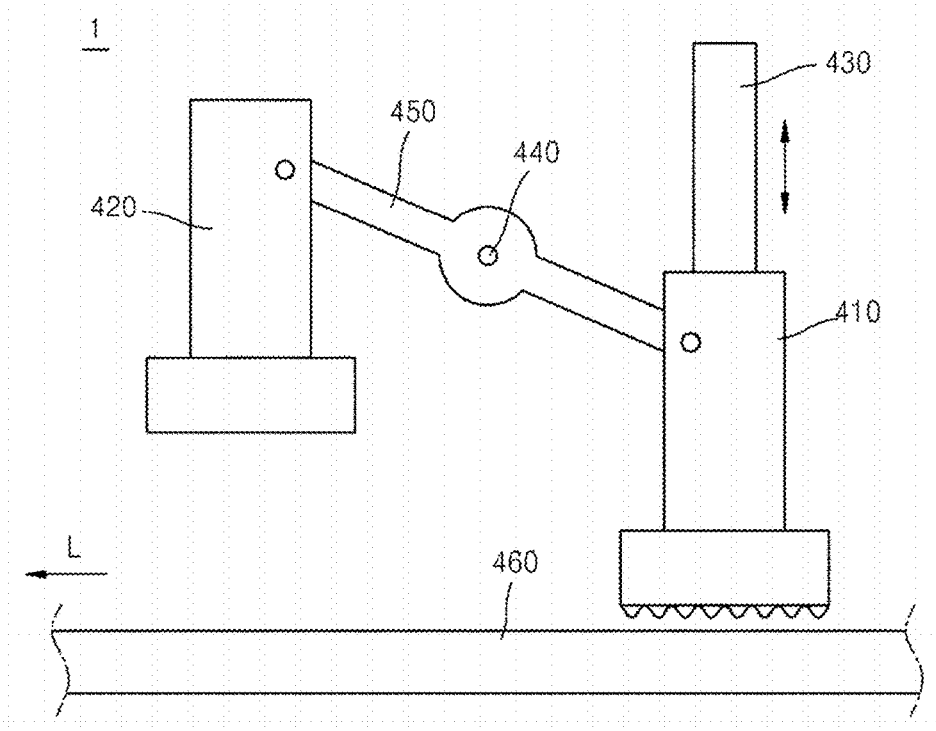

FIGS. 16 and 17 are views illustrating a crusher 1 according to an embodiment of the present invention.

Referring to FIGS. 16 and 17, a crusher 1 according to an exemplary embodiment of the present invention includes a central spindle 440, a connection part 450 performing a seesaw movement about the central spindle 440, a first crushing part 410 and a second crushing part 420 connected by hinges on both sides of the connection part 450 to perform an up-and-down movement, a driver 430 connected to at least one of the first crushing part 410 and the second crushing part 420 to shift the at least one in a vertical direction, and a conveyor 460 disposed under the first crushing part 410 and the second crushing part 420 to convey the medicine packet.

The central spindle 440 is disposed between the first crushing part 410 and the second crushing part 420, and thus the connection part 450 performs a seesaw movement about the central spindle 440.

The first crushing part 410 and the second crushing part 420 are connected by hinges on both sides of the connection parts 450. Thus, according to the seesaw movement of the connection part 450, the first crushing part 410 and the second crushing part 420 are shifted in opposite vertical directions. That is, the first crushing part 410 is shifted upward, and the second crushing part 420 is shifted downward, and vice versa.

The driver 430 is disposed over at least one of the first crushing part 410 and the second crushing part 420. The driver 430 includes a cylinder and a piston. The first crushing part 410 and the second crushing part 420 are shifted in a vertical direction by shifting the piston in the vertical direction. As the first crushing part 410 and the second crushing part 420 is connected to perform a seesaw movement through the connection part 450 and the central spindle 440, as described above, the first crushing part 410 and the second crushing part 420 may move in opposite directions.

A concave-convex part 412 is provided on a bottom of at least one of the first crushing part 410 and the second crushing part 420. Although FIGS. 16 and 17 show that the concave-convex part 412 is provided on the bottom of the first crushing part 410, it will be appreciated that the present invention is not limited thereto. This may facilitate the crushing of the pill to which a pressure or impact is applied by the first crushing part 410.

Further, although FIGS. 16 and 17 show that a traveling direction L of the conveyor 460 is from the first crushing part 410 having the concave-convex part formed therein to the second crushing plate 420, it will be appreciated that the present invention is not limited thereto.

Figure 18:
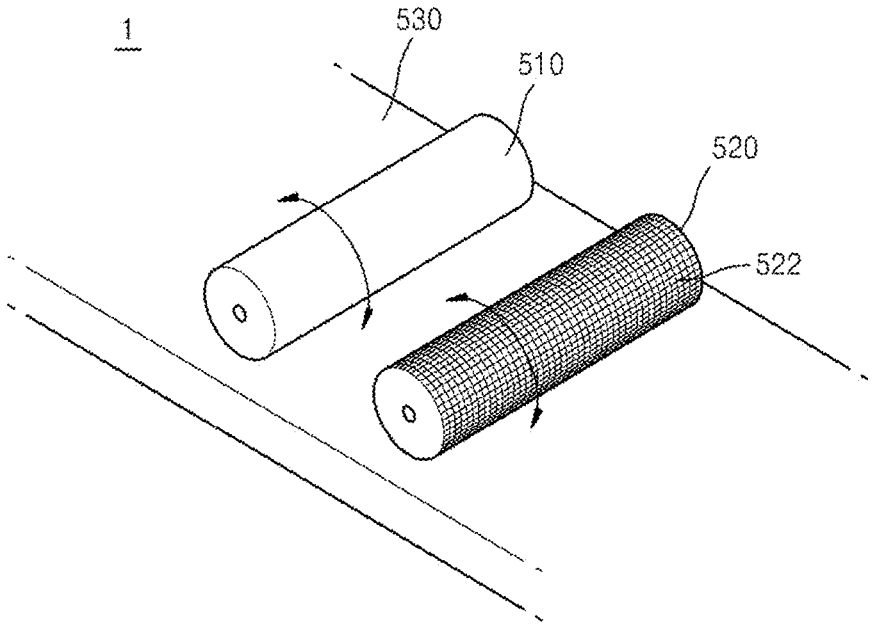

FIG. 18 is a view illustrating a crusher 1 according to an embodiment of the present invention.

Referring to FIG. 18, the crusher 1 according to an embodiment of the present invention may include a conveyor 530 and one or more pressure rollers 510 and 520 disposed over and spaced a certain direction from the conveyor 530.

For example, the conveyor 530 may have the same configuration as a conveyor belt. A plurality of pressure rollers 510 and 520 may be disposed over and spaced a certain distance from the conveyor 530. Thus, a medicine packet with a pill is conveyed using the conveyer 530, and the pill may be crushed by the pressure rollers 510 and 520. Although FIG. 18 shows that the first pressure roller 510 and the second pressure roller 520 are disposed, the present invention is not limited thereto.

At least one of the first crushing plate 510 and the second crushing plate 520 may include a concave-convex part 522. For example, as shown in FIG. 18, the concave-convex part 522 may be formed on the second pressure roller 520, but the present invention is not limited thereto. The first pressure roller 510 and the second pressure roller 520 may rotate in one or both directions, but the present invention is not limited thereto.

Figure 19:
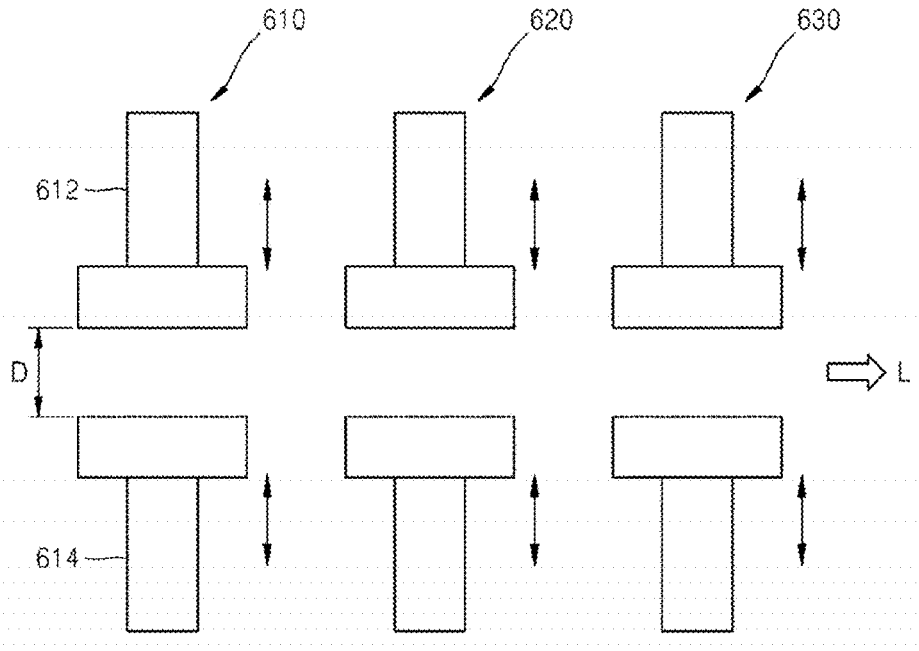
Figure 20:
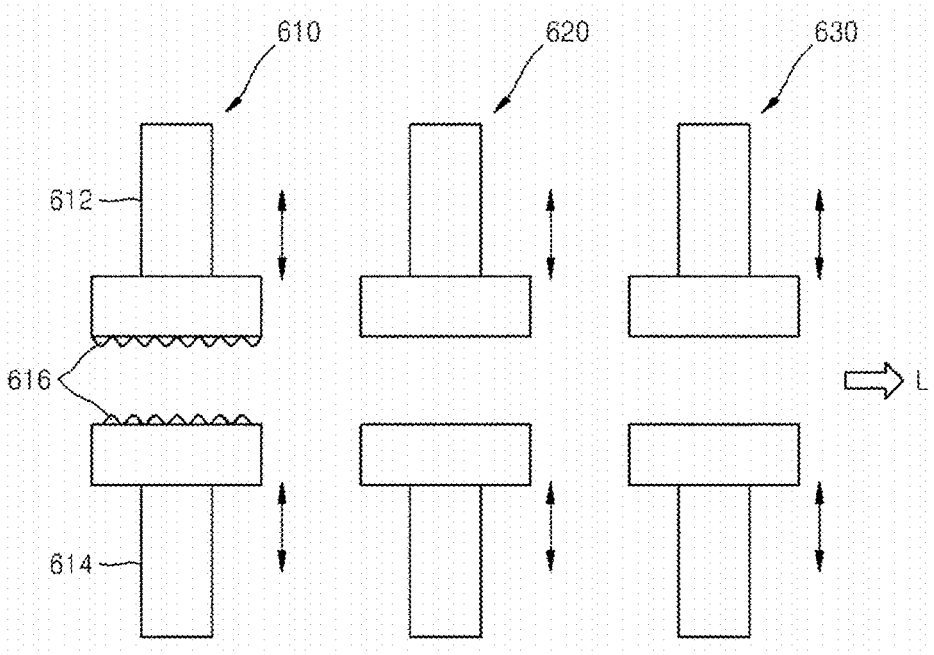

FIGS. 19 and 20 are views illustrating a crusher 1 according to an embodiment of the present invention.

Referring to FIGS. 19 and 20, the crusher 1 according to an embodiment of the present invention may include a plurality of presses.

Each press may include a first pressing part 612 and a second pressing part 614 that are shifted in opposite directions to apply a pressure to a medicine packet with a pill to crush the pill. Although FIG. 19 shows the crusher 1 includes three presses, that is, a first press 610, a second press 620, and a third press 630, each of which includes the first pressing part 612 and the second pressing part 614, the present invention is not limited thereto, and any number of presses may be provided.

The first pressing part 612 and the second pressing 614 are separately shifted to change a distance D therebetween, thereby applying pressure to the medicine packet positioned between the first pressing part 612 and the second pressing part 614 to crush the pill. The medicine packet may be conveyed by a conveyor. For example, the conveyor conveys the medicine packet while holding a portion thereof. The conveyor passes the medicine packet between the first pressing part 612 and the second pressing part 614.

In this case, the first press 610, the second press 620, and the third press 630 may operate independently of or in interaction with each other. That is, the first to third presses 610, 620, and 630 apply pressure simultaneously or sequentially or have the same or different pressing cycles, but the present invention is not limited thereto. In addition, when the pressure is applied, the first to third presses 610, 620, and 630 may have the same or different distances between the first pressing part 612 and the second pressing part 614. For example, the distance between the first pressing part 612 and the second pressing part 614 of the first press 610 that applies pressure first is comparatively great. The distance between the first pressing part 612 and the second pressing part 614 sequentially decreases in a traveling direction L while the pill in the medicine packet is crushed. The distance between the first pressing part 612 and the second pressing part 614 of the third press 630 may be less than that of the second press 620. However, the present invention is not limited thereto. Thus, the medicine packet may be prevented from being damaged while the pill is effectively crushed.

As shown in FIG. 20, a concave-convex part 616 may be provided on facing portions of the first pressing part 612 and the second pressing part 614. The concave-convex part 616 may have a shape in which protrusions and recesses are repeatedly arranged, thus more effectively crushing the pill inside the medicine packet. Although FIG. 20 shows that the concave-convex part 616 is formed on the first pressing part 612 and the second pressing part 614 of the first press 610, the present invention is not limited thereto. The concave-convex part 616 may be formed on any pressing part.

Contact portions of the first pressing part 612 and the second pressing part 614 may be formed of, for example, a rigid material or an elastic material such as rubber to prevent damage of a medicine packet. However, the present invention is not limited thereto. For example, each of the contact portions may include a coating layer formed of urethane or rubber, and the coating layer may be formed on the part where the concave-convex part 616 is formed.

In addition, the concave-convex part 616 may also be formed of an elastic material, but the present invention is not limited thereto. The first press 610, the second press 620, and the third press 630 may be formed of different materials, but the present invention is not limited thereto.

FIGS. 21 to 24 are sectional views of the concave-convex part 616.

Figure 21:
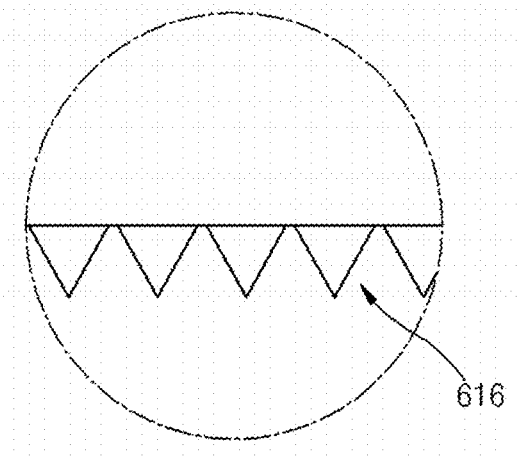
Figure 22:
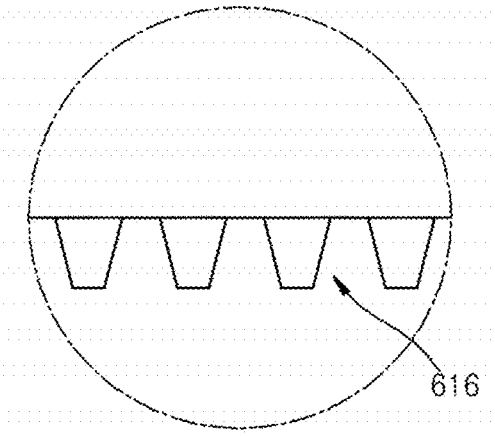
Figure 23:
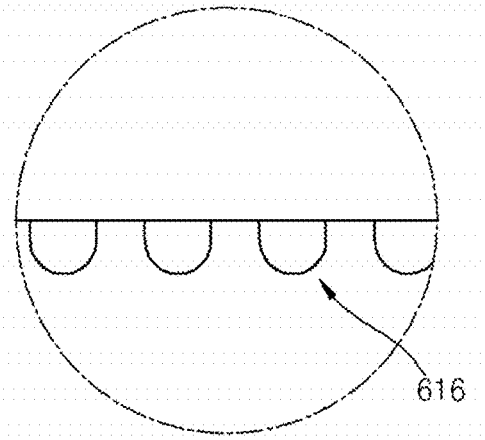
Figure 24:
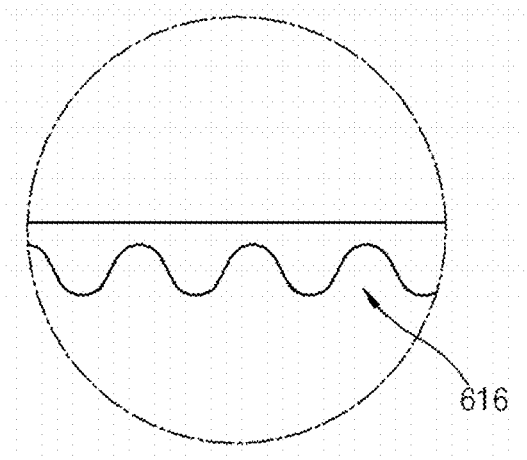

For example, the concave-convex part 616 may have a shape in which a plurality of triangular protrusions are provided as shown in FIG. 21, and may have a shape in which tips of the plurality of triangular protrusions are flattened as shown in FIG. 22. The concave-convex part 616 may have a shape in which a plurality of curved protrusions are provided as shown in FIG. 23, and may have a shape in which a plurality of curved protrusions and a plurality of curved recesses are repeatedly arranged as shown in FIG. 24. The shape and structure of the concave-convex part 616 are not limited to those as shown in FIGS. 21 to 24. Thus, the concave-convex part 616 may have any shape and structure.

FIGS. 25 to 28 are views showing the concave-convex part 616 in three dimensions according to an embodiment of the present invention.

Figure 25:
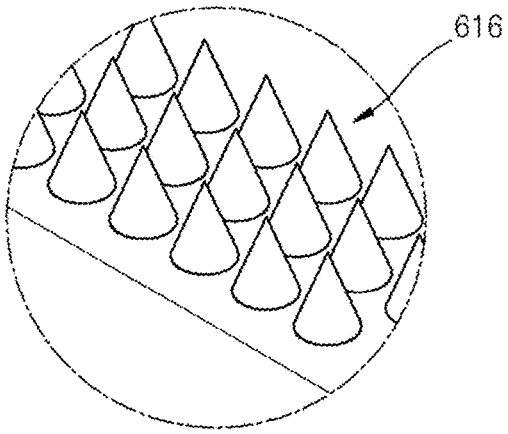
Figure 26:
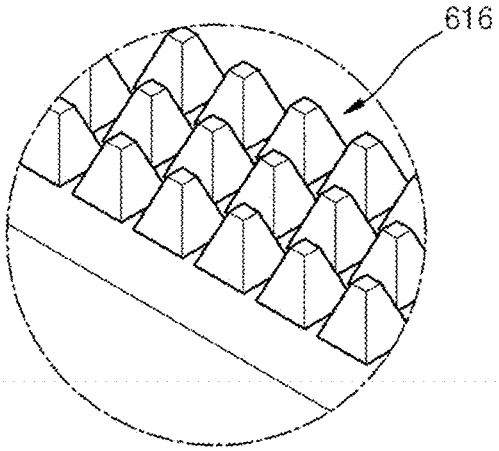

As shown in FIGS. 25 and 26, the concave-convex part 616 may have a shape in which multiple small pyramids are formed. In this case, the pyramid may include a polygonal pyramid or a circular pyramid, but the present invention is not limited thereto. A tip of the pyramid may be sharp or flattened, but the present invention is not limited thereto.

Figure 27:
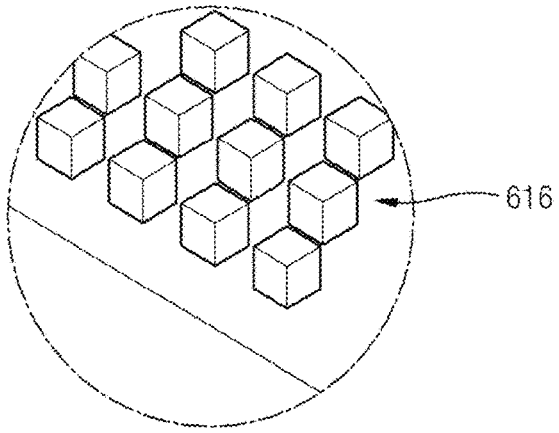

Furthermore, as shown in FIG. 27, the concave-convex part 616 may have a shape in which multiple three-dimensional features are disposed. Although FIG. 27 shows that multiple hexahedrons are disposed, it is obvious that the present invention is not limited thereto.

Figure 28:
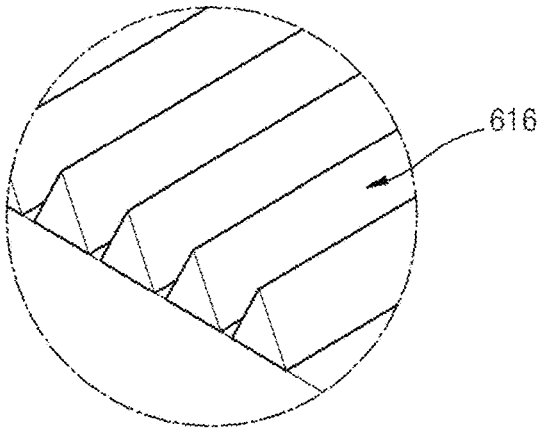

As shown in FIG. 28, the concave-convex part 616 may have a three-dimensional shape in which multiple rows are extended in at least one direction, but the present invention is not limited thereto.

Figure 29:
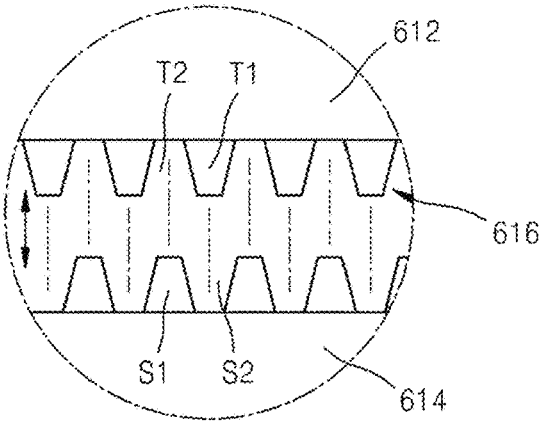
Figure 30:
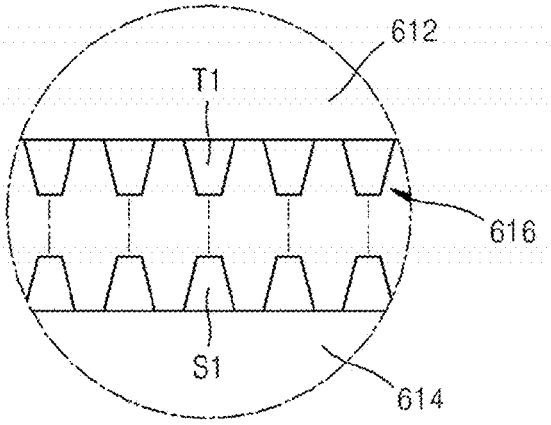

FIGS. 29 and 30 are views showing a positional relation between the first pressing part 612 and the second pressing part 614.

For example, as shown in FIGS. 29 and 30, when the concave-convex part 616 is formed on each of the first pressing part 612 and the second pressing part 614, the concave-convex parts 616 are disposed such that the protrusions are aligned with the recesses or such that the protrusions are aligned with each other.

For example, as shown in FIG. 29, the first pressing part 612 and the second pressing part 614 may be positioned such that a protrusion T1 and a recess T2 of the concave-convex part 616 formed on the first pressing part 612 are aligned with a recess S2 and a protrusion S1 of the concave-convex part 616 formed on the second pressing part 614, respectively.

On the contrary, as shown in FIG. 30, the first pressing part 612 and the second pressing part 614 may be positioned such that the protrusion T1 of the concave-convex part 616 formed on the first pressing part 612 is aligned with the protrusion S1 of the concave-convex part 616 formed on the second pressing part 614.

The positional relation of the concave-convex parts 616 according to FIGS. 29 and 30 is merely an example, and thus it is obvious that the concave-convex parts 616 may have any positional relation.

Figure 31:
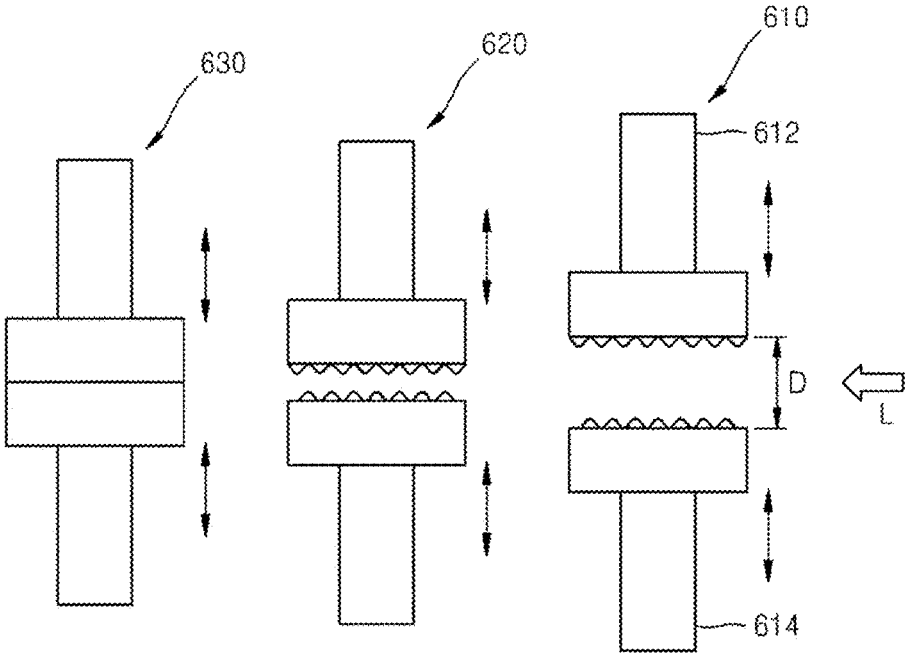

FIG. 31 is a view showing an example of operating the plurality of presses.

A distance D between the first pressing part 612 and the second pressing part 614 constituting the press may sequentially decrease in a traveling direction L of a medicine packet. For example, as shown in FIG. 31, the distance D between the first pressing part 612 and the second pressing part 614 may sequentially decrease as the medicine packet is moved from the first press 610 to the third press 630. Accordingly, pressures may be sequentially applied to a pill in the medicine packet, thus preventing damage of the medicine packet caused by pressing and crushing the pill. In this case, the concave-convex part 616 may be formed on a pressing part, and the present invention is not limited to that shown in the drawings.

The above-described embodiment may be applied to a case in which a press is provided over a conveyor to apply a pressure to a medicine packet conveyed on the conveyor and a distance between the conveyor and the press sequentially decreases.

Figure 32:
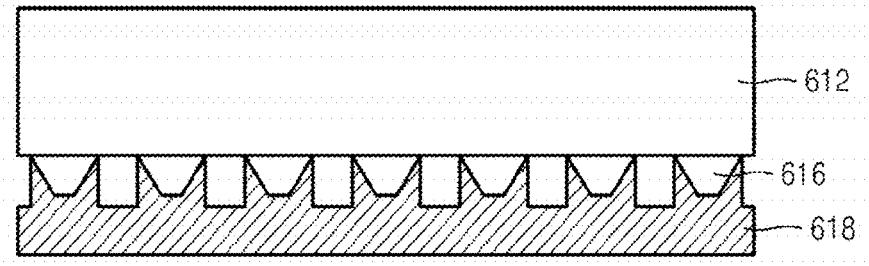
Figure 33:
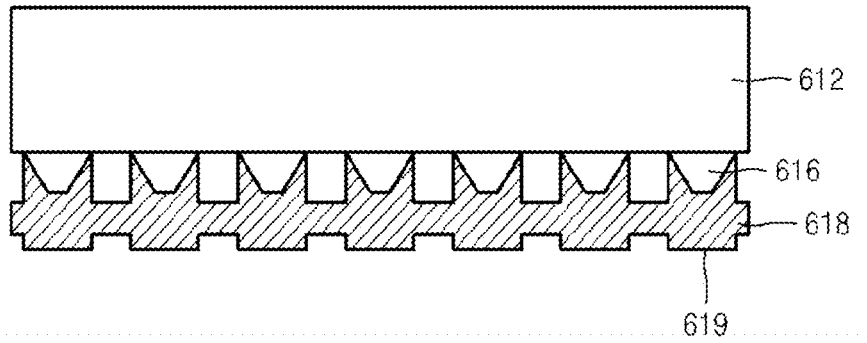

FIGS. 32 and 33 are views illustrating a pressing part according to another embodiment of the present invention.

Referring to FIGS. 32 and 33, the concave-convex part 616 may be formed on the pressing part 612, and a coating part 618 may be formed on a concave-convex surface having the concave-convex part 616.

The coating part 618 may be formed of, for example, a ductile material such as rubber and urethane, thus preventing damage of the medicine packet caused by applying pressure.

As shown in FIG. 33, an additional concave-convex part 619 may be formed on the bottom of the coating part 618. A comparatively large pill or crushed particles of the pill may be contained in a recess formed on the concave-convex part 619, thus reliably preventing damage of the medicine packet.

Figure 34:
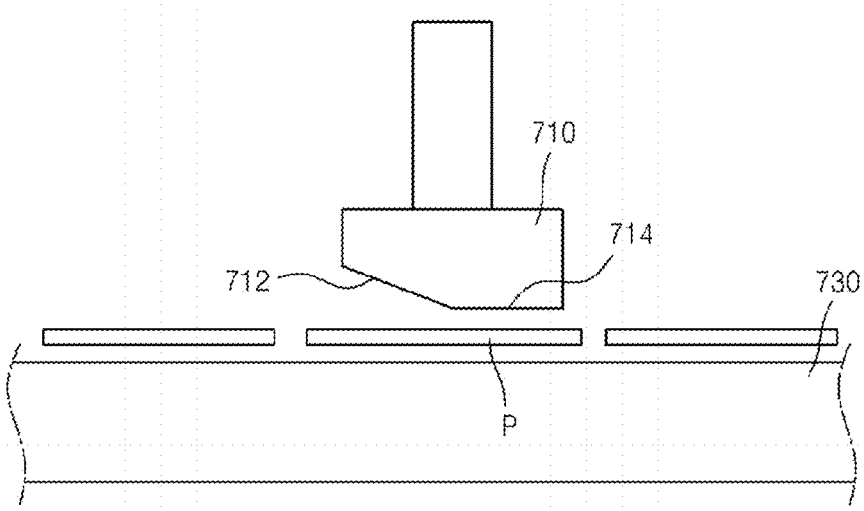
Figure 35:
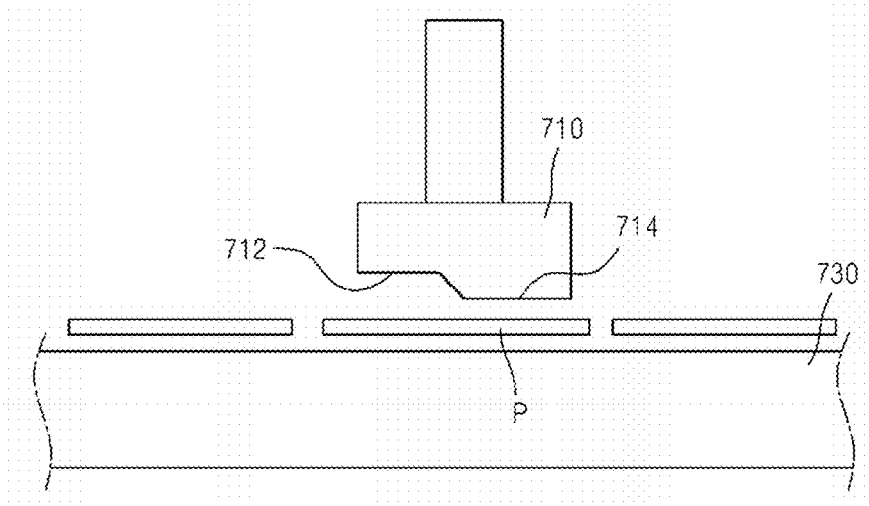

FIGS. 34 and 35 are views illustrating an apparatus for preparing medicines according to another embodiment of the present invention.

Referring to FIGS. 34 and 35, a crushing according to an embodiment of the present invention includes a supporting part 730 on which a medicine packet P including a pill and a crushing part configured to apply a pressure to the medicine packet P to crush the pill. The crushing part includes a head 710 that applies a pressure to the medicine part P. A bottom of the head 710 has an impact surface that comes in contact with and applies an impact to the medicine packet P. The impact surface partially has different heights.

In this case, the head 710 may preferably have an area equal to or less than the medicine packet P. Thus, when the head 710 presses the medicine packet P, the impact surface is partially separated from the medicine packet P, thus avoiding contact of the whole medicine packet P with the head 710.

That is, when the impact surface, which is the bottom of the head 710, comes in contact with and applies an impact to the medicine packet P, at least one portion of the medicine packet P is not in contact with the impact surface, thus preventing the entire medicine packet P from being pressed. Accordingly, the medicine packet P may be prevented from being broken or damaged due to internal air pressure.

The impact surface, which is the bottom of the head 710, may have different heights, thereby forming a stepped portion on the impact surface or forming an inclined portion having a certain inclination angle on at least one portion of the impact surface.

For example, the head 710 may include a first surface 712 and a second surface 714 that have different heights. Here, any one of the first surface 712 and the second surface 714 may be formed as an inclined surface, but the present invention is not limited thereto.

Figure 46:
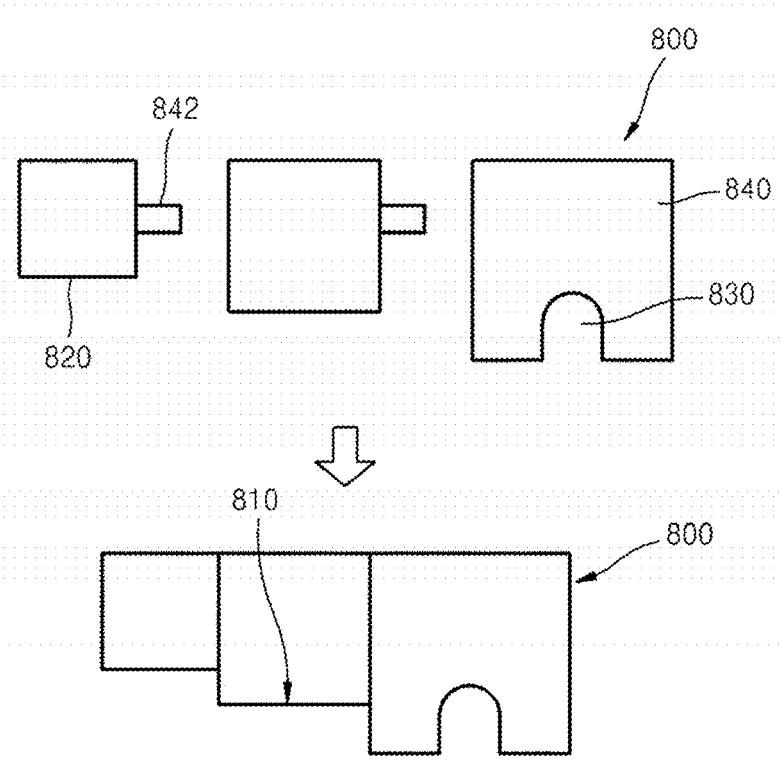
FIGS. 46 and 47 are views illustrating structures of exemplary pressing parts of exemplary apparatuses for preparing medicines according to various embodiments of the present disclosure.
Figure 47:
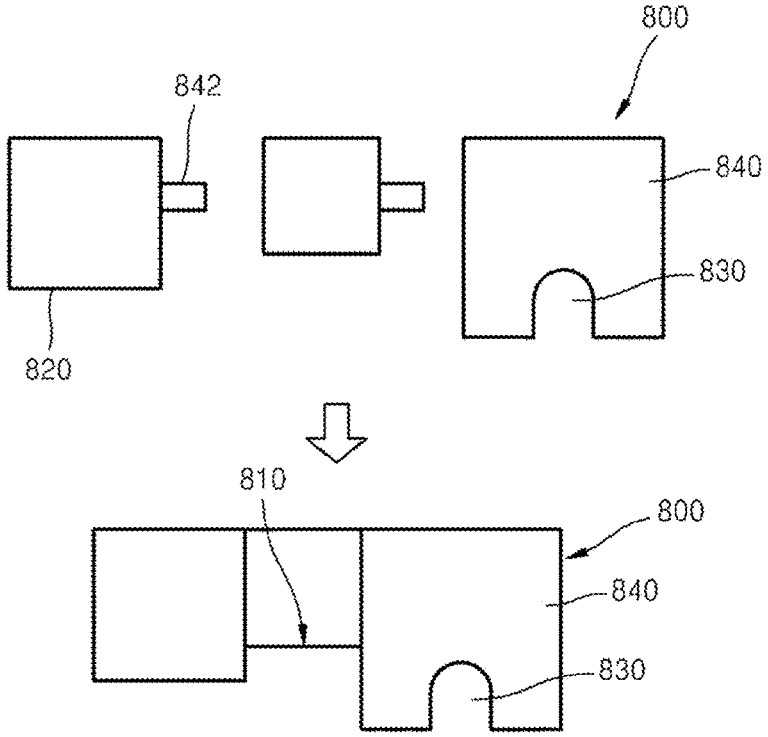

FIGS. 36 to 45 are views illustrating a structure of an apparatus for preparing medicines according to an embodiment of the present invention. FIGS. 46 and 47 are views illustrating a structure of a pressing part 800 of an apparatus for preparing medicines according to an embodiment of the present invention.

An apparatus for preparing medicines according to an embodiment of the present invention includes a supporting part 802 on which a medicine packet with a pill is mounted, and a pressing part 800 configured to press the medicine packet with the pill to crush the pill. The pressing part 800 includes a pressure surface 810 that comes in contact with and applies an impact to the medicine packet when the medicine packet is pressed. The pressure surface 810 partially has different heights and thus different distances from the supporting part 802.

The medicine packet with the pill is positioned on the supporting part 802. In this case, a conveyer that conveys the packet may be further provided on the supporting part 802. For example, the conveyor may include, but not limited to, a conveyor belt or a conveying means. In addition, the conveyer and the supporting part 802 may be integrally formed to simultaneously perform the conveying and supporting.

The pressing part 800 applies a pressure to the packet positioned on the support 802 to crush the pill in the packet. Thus, the pressing part 800 may be formed of a material having weight and intensity sufficient for the pressing part 800 to be shifted in a certain direction to apply an impact to the packet. A driver for shifting the pressing part 800 may be provided. For example, the driver may shift the pressing part 800 on the supporting part 802 in a vertical direction to apply an impact to the pill in the packet.

When the pressing part 800 applies a pressure to the packet, at least one side of the pressing part 800 comes in contact with the packet. Thus, the pressing part 800 may include a pressure surface 810 that applies an impact to the pill in the packet. It can be understood that the pressure surface 810 is not limited to one side of the pressing part 800 but refers to any part that comes in contact with the packet and applies a substantial impact to the pill.

The pressure surface 810 has different heights and thus different distances from the supporting part 802.

Figure 36:
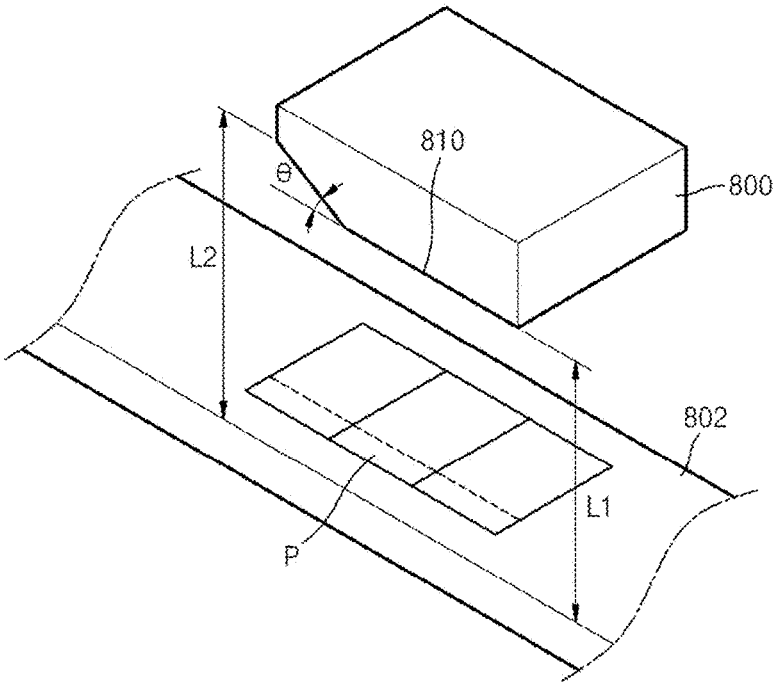
FIGS. 36 to 45 are views illustrating structures of exemplary apparatuses for preparing medicines according to various embodiments of the present disclosure.

As shown in FIG. 36, the pressure surface 810 may partially have different heights. In this case, it can be understood that the term "height" refers to a distance between the pressure surface 810 and the supporting part 802 when the pressing part 800 is positioned over the supporting part 802 positioned on a floor, and the term "different height" denotes that the distance is different. In other words, it can be understood that the pressing part 800 is formed of a member partially having different thicknesses or the pressure surface 810 of the pressing part 800 is not a plane surface but an uneven surface or a surface having a three-dimensional structure.

As an example, the pressure surface 810 may include an inclined surface having an inclination angle with respect to the supporting part 802. That is, as shown in FIG. 26, at least one portion of the pressure surface 810 may be an inclined surface having a certain inclination angle θ with respect to the supporting part 802. Thus the distance between the pressure surface 810 and the supporting part 802 may be partially different.

Figure 37:
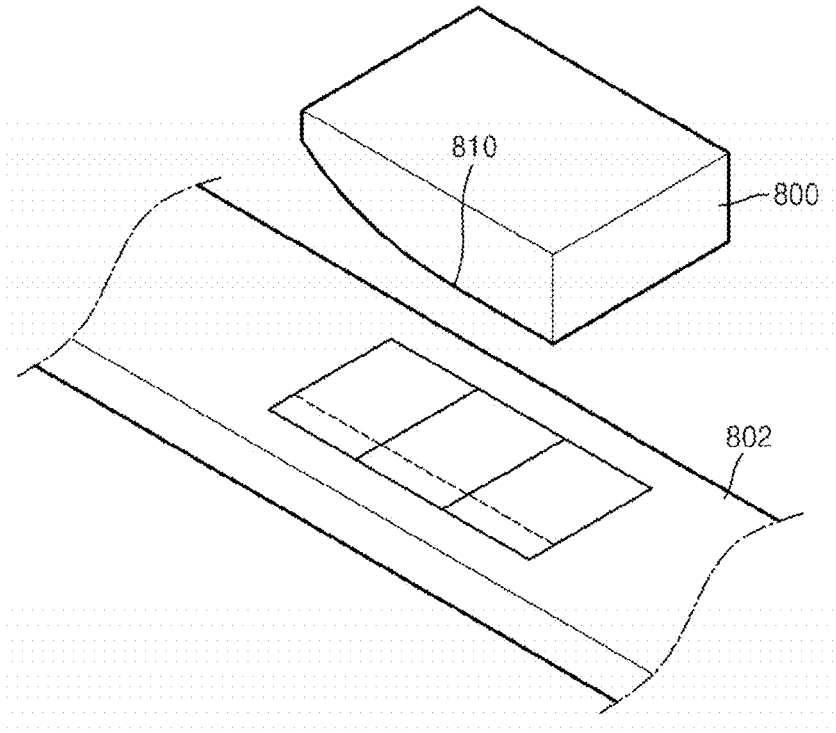

As an example, preferably, at least one portion of the pressure surface 810 may be inclined with respect to the supporting part 802, and may be curved with a certain curvature by increasing or decreasing the inclination angle. As shown in FIG. 37, at least one portion of the pressure surface 810 may be an inclined surface having a certain inclination angle with respect to the supporting part 802. A curved surface with a certain curvature may be formed by partially increasing or decreasing the inclination angle. Thus, the distance between the pressure surface 810 and the supporting part 802 may be partially different.

According to an embodiment of the present invention, one or more steps 815 are formed on the pressure surface 810 to include a plurality of impact surfaces 820 having different heights. The plurality of impact surfaces 820 have different distances from the supporting part 802.

Figure 38:
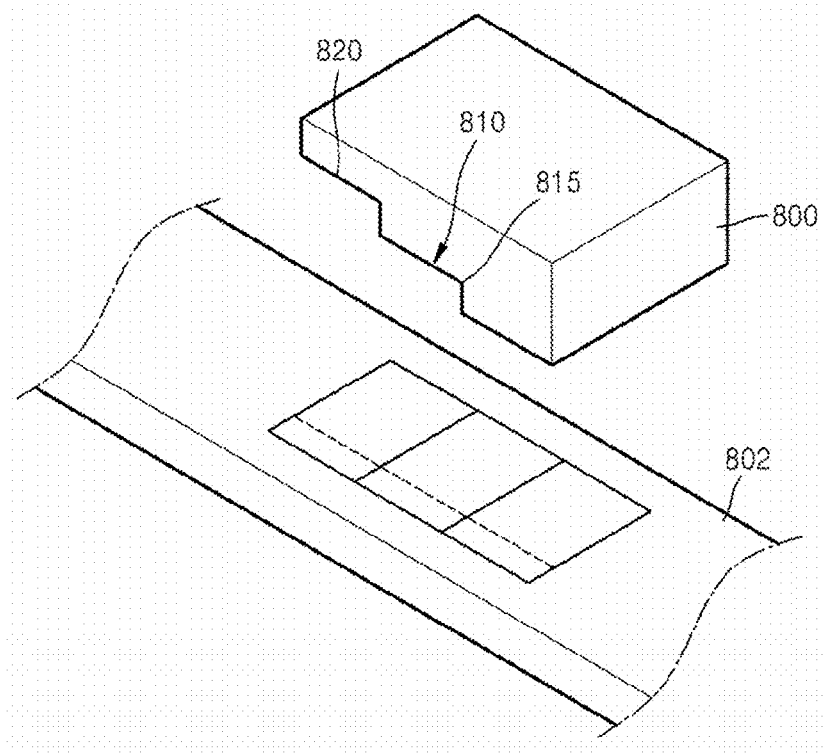

That is, as shown in FIG. 38, the pressure surface 810 may include one or more steps 815, and may have a plurality of impact surfaces 820 divided by the steps 815. Here, it can be understood that the term "step" refers to a stepped portion that allows the pressure surface 810 to partially have different heights.

The press application surface 810 is partially divided by the steps 815, each of which may be referred to as the impact surface 820. As an example, as shown in FIG. 38, when two steps 815 may be formed, the pressures application surface 810 may be divided into three impact surfaces 820 by the steps 815. That is, the pressure surface 810 may include the three impact surfaces 820. In addition, as described above, the impact surface 820 may have different distances from the supporting part 802.

Figure 39:
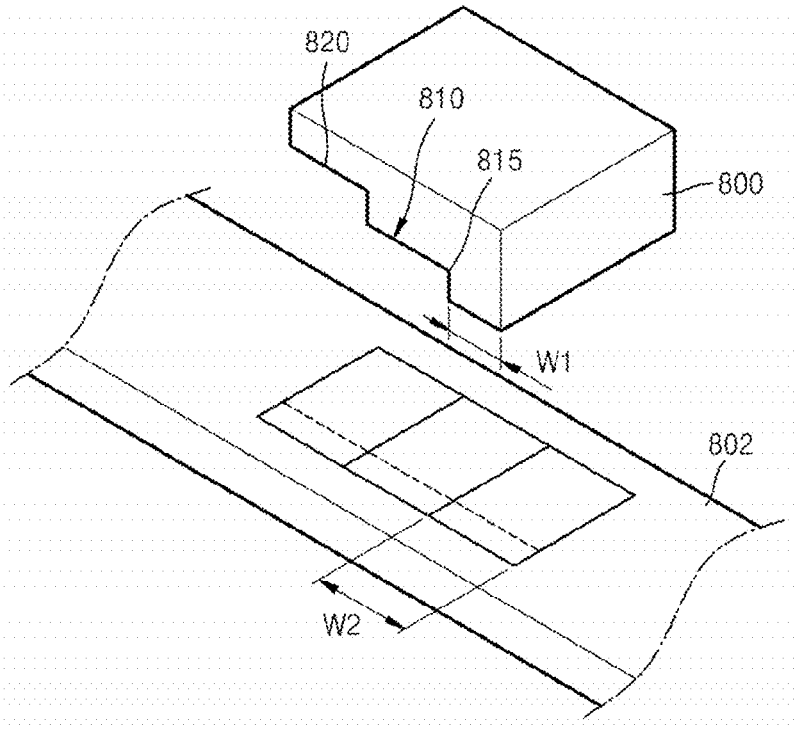

As shown in FIG. 39, in the impact surface 820 having the steps 815, a width W1 of the bottom step may be less than a width W2 of the medicine packet P. Thus, when pressure is applied by the impact surface 820, the whole medicine packet P may not be pressed and the air in the medicine packet P may be moved into at least one side, thus preventing damage of the medicine packet P.

According to an embodiment of the present invention, preferably, the steps 815 ascend or descend in one direction, and a distance between the impact surface 820 and the supporting part 802 sequentially increases or decreases in one direction.

That is, as shown in FIG. 38, the steps 815 may have an upward or downward step structure. Accordingly, the distance between the impact surface and the supporting part 802 may sequentially increase or decrease in one direction.

Figure 40:
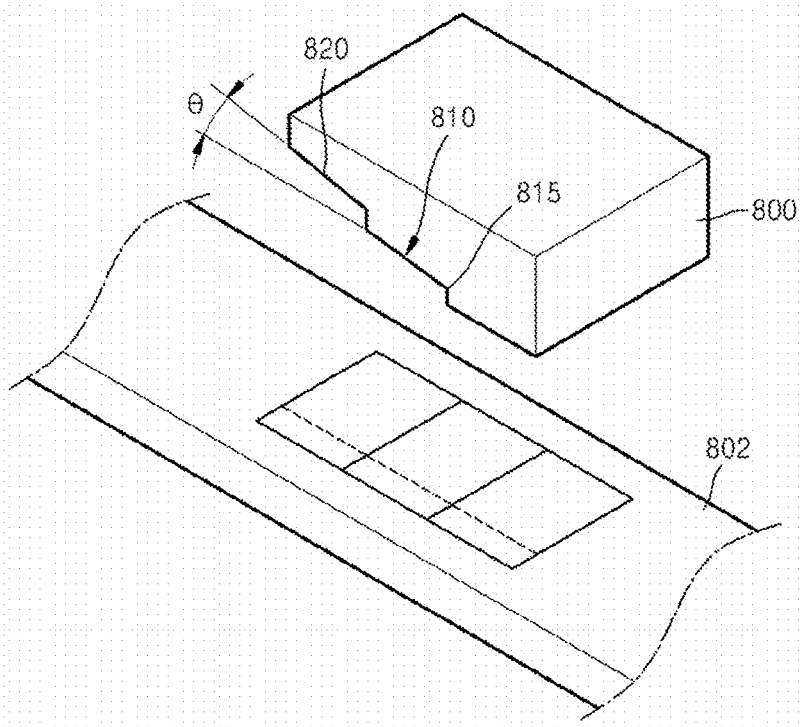
Figure 41:
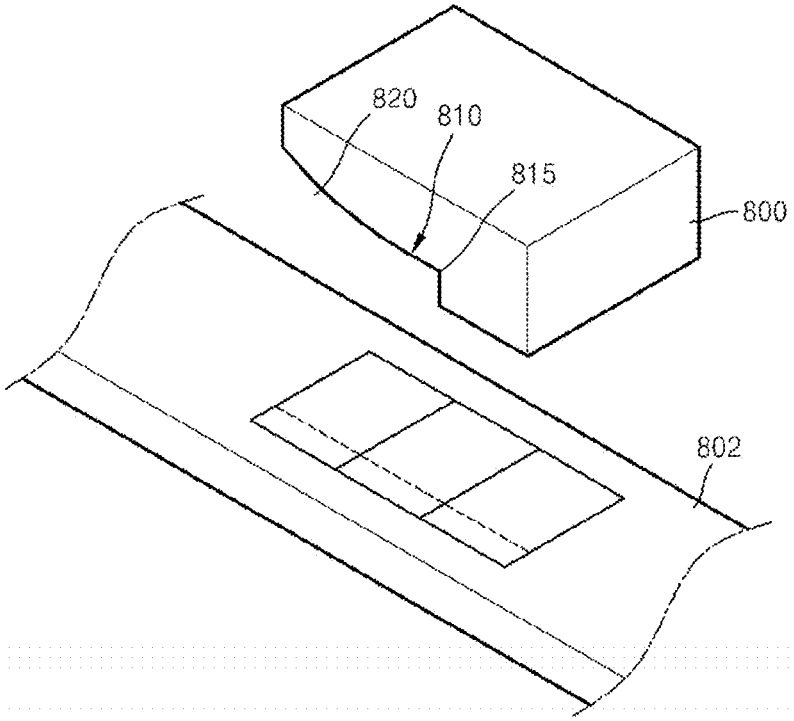

Each impact surface 820 may have a structure that facilitates the crushing and grinding of the pill and the prevention of damage of the medicine packet. As an example, preferably, at least one of the plurality of impact surfaces 820 may have an uneven portion, thus facilitating the crushing of the pill. As another example, at least one of the plurality of impact surfaces 820 may be formed as an inclined surface having an inclination angle with respect to the supporting part 802 as shown in FIG. 40 and as a curved surface with a curvature as shown in FIG. 41. However, the present invention is not limited thereto.

As described above, since the parts having different distances between the pressure surface 810 of the pressing part 800 and the supporting part 802 are included, at least one portion of the medicine packet is not in contact with the pressure surface 810 when the medicine packet is pressed through the pressing part 800. Accordingly, it is possible to prevent the entire medicine packet from being pressed and thus prevent the medicine packet from being broken or damaged due to internal air pressure.

In addition, as described above, since the parts having different distances between the pressure surface 810 of the pressing part 800 and the supporting part 802 are included, it is possible to appropriately press and crush the pill depending on the size.

That is, under a condition that there are large pills and small pills together, the large pills are crushed by a first impact applied in a part in which the distance between the supporting part 802 and the impact surface 820 is comparatively great, and then the small pills are crushed by a second impact applied in a part in which the distance between the supporting part 802 and the impact surface 820 is comparatively small.

Thus, compared to when all pills are pressed and crushed by the impact surfaces 820 having the same distance, the crushing may be performed uniformly even by a small power source.

In addition, the crushing may be more effectively secured when the steps 815 ascend or descend in one direction and a distance between the impact surface 820 and the supporting part 802 sequentially increases or decreases in one direction. It is the same even with the inclined surface or the curved surface.

Figure 42:
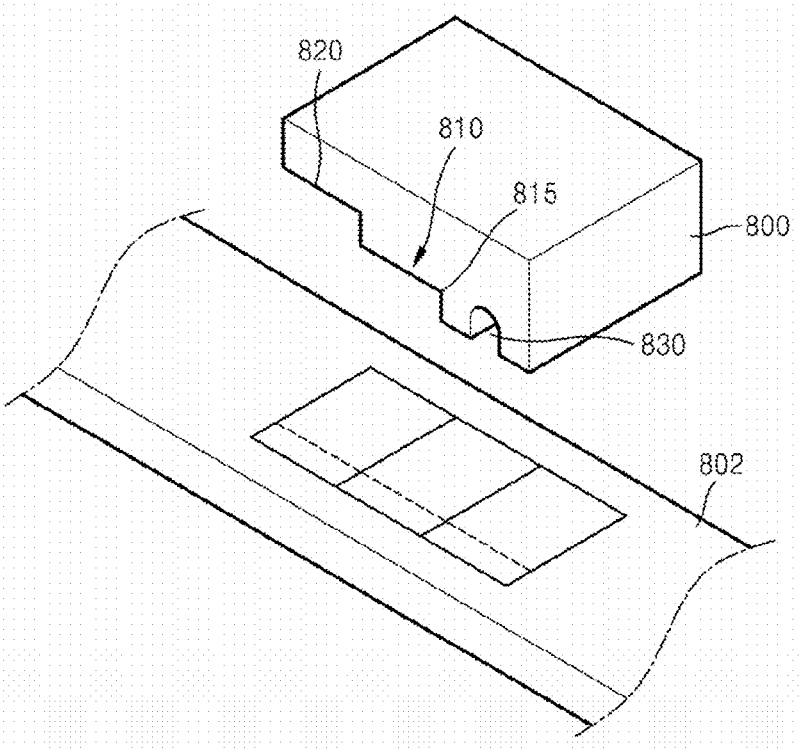

FIG. 42 is a view showing an apparatus for preparing medicines) according to an embodiment of the present invention.

Preferably, at least one of the plurality of impact surfaces 820 may have a groove 830 in which air in the packet may be captured.

Figure 43:
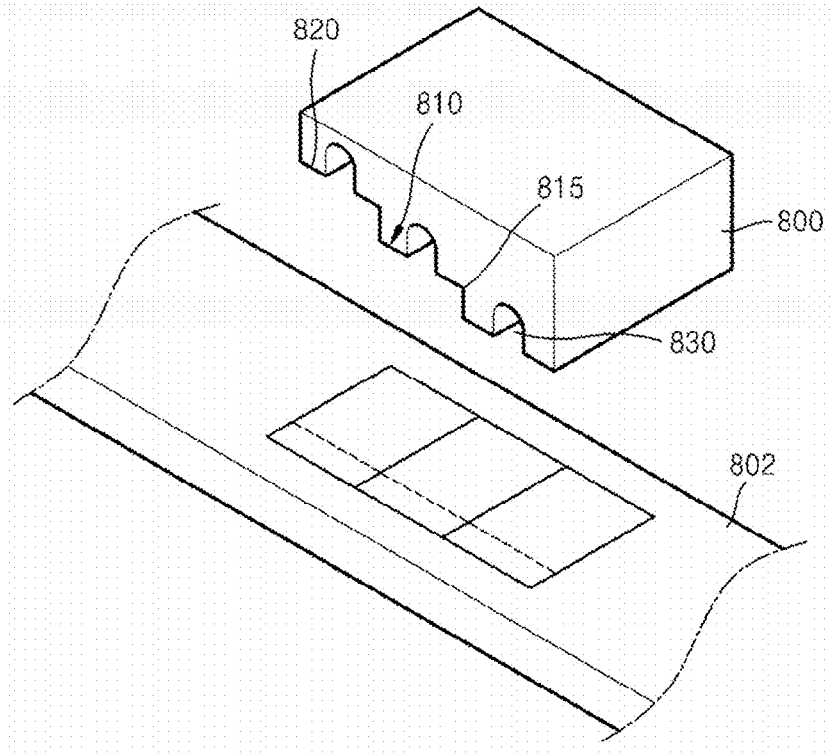

As an example, as shown in FIG. 42, the groove 830 may be formed on an impact surface 820 that is closest to the supporting part 802. However, the groove 830 has no limitation in its position and also number. For example, as shown in FIG. 43, the groove 830 may be formed on each impact surface 820.

The groove 830 may have a certain depth and size. When the medicine packet is pressed, a portion of the medicine packet may be inflated with air in the medicine packet that is input into the groove 830.

The groove 803 may facilitate the prevention of the medicine packet from being broken or damaged when the pressure is applied by the pressing part 800.

Figure 44:
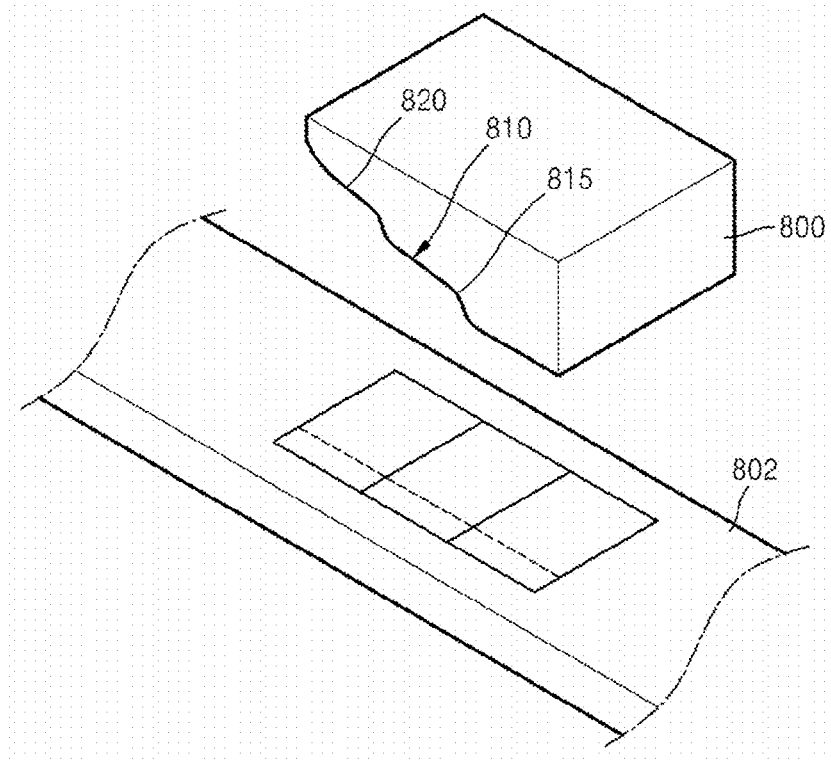

FIG. 44 is a view showing a pressing part 800 according to an embodiment of the present invention.

Figure 45:
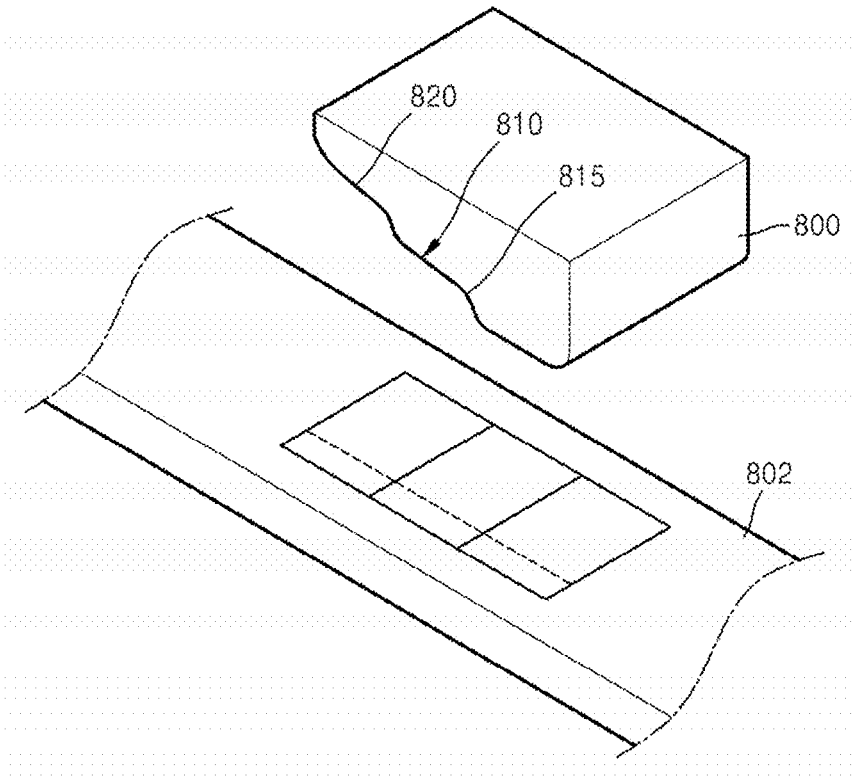

Referring to FIG. 45, preferably, edges of the plurality of impact surfaces 820 may be curved with a certain curvature.

That is, an edge of each of the steps 815 corresponding to the impact surfaces 820 may be polished or processed to have a curved surface. Thus, the impact surfaces 820 may be curved to be smoothly connected to each other. This structure may prevent the medicine packet from being broken or damaged by the edge of the impact surface 820. As shown in FIG. 45, an outer edge of the pressing part 800 may be curved, but the present invention is not limited thereto.

FIGS. 46 and 47 are views illustrating a crusher 800 of an apparatus for preparing medicines 1 according to an embodiment of the present invention.

Referring to FIGS. 46 and 47, preferably, the pressing part 800 may include a plurality of pressure units 840 that are selective detachable, each of which may have one or more impact surface 820.

That is, the pressing part 800 may include a plurality of pressure units 840, each of which has a detachable structure and includes one or more impact surfaces 820.

The pressure units 840 may be connected by any connection means. As an example, in order to connect the pressure units 840, a protrusion 842 and a recess (not shown) into which the protrusion is inserted are disposed on a side of each pressure unit 840. However, the present invention is not limited thereto. Thus, the pressure unit 840 may be formed of a member such as a block, and the pressing part 800 may have a structure in which a plurality of blocks are coupled.

Each pressure unit 840 may include one or more impact surfaces 820. That is, one pressure unit 840 may form one impacting 820, and a distance between the impact surface 820 and the supporting part 820 may be different as described above.

As an example, when there are various types and sizes of pills in the medicine packet, multiple impact surfaces 820 having different distances may be needed. In this case, the pressing part 800 having multiple impact surfaces 820 may be formed by connecting the plurality of pressure units 840. As another example, when there are a few types and sizes of pills in the medicine packet, only a small number of impact surfaces 820 may be needed to crush the pill. In this case, a pressing part 800 having a few impact surfaces 820 may be formed by connecting only a small number of pressure units 840.

In addition, the pressure surface 810 may have various three-dimensional figures depending on the purpose of the crushing and the shape of the pill. That is, the pressure surface 810 having the above-described sequential steps 815 may be formed by arbitrarily selecting a connection form of the pressure units 840. As shown in FIG. 47, the pressure surface 810 having a recess surface may be formed. However, the present invention is not limited thereto.

The pressing part 800 including a plurality of detectable pressure units 840 may allow the pill to be more effectively crushed and also may more effectively prevent damage of the medicine packet with the pill.

As described above, according to the one or more of the above exemplary embodiments, a step of crushing the pill to prepare a medicinal powder may be performed after the inserting the pills into the medicine packets. Accordingly, the pills are crushed inside the medicine packets, thus preventing medicinal particles from being generated by crushing the pills. Further, since the pills are crushed inside the medicine packets, medicinal particles cannot be stuck to the crusher. Thus, the required amount of medicine can be exactly distributed, the crusher do not need to be cleaned, and an unnecessary medicinal component that is resulted from a drug stuck to the crusher may be prevented from being mixed.

Preferably, the pressing part and the impact part are included. Since the first pressure and the second pressure are applied by the pressing part and the impact part, respectively, the pill inside the medicine packet can be uniformly crushed. That is, the pill inside the medicine packet may be partially crushed, uniformly distributed on a plane, and fixed by the first pressure applied by the pressing part and then may be uniformly crushed by the second pressure applied by the impact part.

By dropping the impact poles to apply the second pressure, it is possible to easily apply an impact to the medicine packet and the pill inside the medicine packet which are disposed between the pressing part and support part, and thus effectively crush and grind the pill.

Preferably, by applying a pressure on the impact poles through the impact plate, the pressure or impact may be applied to the pill through the impact part and the pressing part three times, thereby resulting in effective crushing and grinding.

It should be understood that the exemplary embodiments described therein should be considered in a descriptive sense only and not for purposes of limitation. Descriptions of features or aspects within each exemplary embodiment should typically be considered as available for other similar features or aspects in other exemplary embodiments.

While one or more exemplary embodiments have been described with reference to the figures, it will be understood by those of ordinary skill in the art that various changes in form and details may be made therein without departing from the spirit and scope as defined by the following claims.

What is claimed is:

1. A system for preparing medicines comprising:

a medicine packet, having a pre-determined width (W2), enclosing a pill;

a supporting part on which the medicine packet is mounted; and a pressing part configured to press the medicine packet against the supporting part to crush the pill, wherein the pressing part comprises a pressure surface configured to apply an impact to the medicine packet when the medicine packet is pressed by the pressing part, wherein the pressure surface comprises one or more steps dividing the pressure surface into a plurality of impact surfaces, each having a different height relative to the supporting part such that at least one portion of the medicine packet is not in contact with the pressure surface when the medicine packet is pressed by the pressing part, wherein a distance between each one of the plurality of impact surfaces and the supporting part sequentially increases or decreases in one direction, wherein among the plurality of impact surfaces, a bottom-level impact surface, which is separated from the supporting part by the smallest distance between the plurality of impact surfaces and the supporting part, has a predetermined width (W1) that is parallel to the predetermined width (W2) of the medicine packet mounted on the supporting part, and wherein the predetermined width (W1) of the bottom-level impact surface is less than the predetermined width (W2) of the medicine packet.

2. The system for preparing medicines of claim 1, wherein the pressure surface has an inclined surface having a predetermined inclination angle with respect to the supporting part formed on at least one portion thereof.

3. The system for preparing medicines of claim 1, wherein the pressure surface has a curved surface having a predetermined curvature formed on at least one portion thereof, by increasing or decreasing a predetermined inclination angle with respect to the supporting part.

4. The system for preparing medicines of claim 1, wherein at least one of the plurality of impact surfaces comprises a groove for capturing air in the medicine packet.

5. The system for preparing medicines of claim 1, wherein at least one of the plurality of impact surfaces has an uneven surface.

6. The system for preparing medicines of claim 1, wherein an edge of each of the plurality of impact surfaces is curved.

7. The system for preparing medicines of claim 1, wherein the pressing part comprises a plurality of detachable pressure units, each of the detachable pressure units having one or more impact surfaces.

8. The system for preparing medicines of claim 1, wherein the pressure surface is configured to simultaneously contact a plurality of respective medicine packets, each corresponding to one of the plurality of impact surfaces; and wherein each of the plurality of respective medicine packets receives a different amount of pressure.

9. The system for preparing medicines of claim 1, wherein the medicine packet encloses a plurality of pills of different sizes.

* * * * *